US011388505B2

(12) United States Patent
Wolfe

(10) Patent No.: US 11,388,505 B2
(45) Date of Patent: Jul. 12, 2022

(54) WEARABLE EARBUD SYSTEM

(71) Applicant: James Wolfe, Venice, CA (US)

(72) Inventor: James Wolfe, Venice, CA (US)

(73) Assignee: James Wolfe, Venice, CA (US)

( * ) Notice: Subject to any disclaimer, the term of this patent is extended or adjusted under 35 U.S.C. 154(b) by 0 days.

(21) Appl. No.: 16/722,223

(22) Filed: Dec. 20, 2019

(65) Prior Publication Data

US 2020/0128314 A1 Apr. 23, 2020

Related U.S. Application Data

(63) Continuation-in-part of application No. PCT/US2019/013987, filed on Jan. 17, 2019.

(60) Provisional application No. 62/618,921, filed on Jan. 18, 2018.

(51) Int. Cl.
*H04R 1/10* (2006.01)

(52) U.S. Cl.
CPC ..... *H04R 1/105* (2013.01); *H04R 1/1016* (2013.01); *H04R 1/1041* (2013.01); *H04R 1/1058* (2013.01); *H04R 2420/05* (2013.01)

(58) Field of Classification Search
CPC .... H04R 1/105; H04R 1/1041; H04R 1/1016; H04R 1/1058; H04R 2420/05; A45F 2005/006
USPC ..... 381/74, 378, 370, 380, 385; 224/257, 224/258, 183, 562, 607
See application file for complete search history.

(56) References Cited

U.S. PATENT DOCUMENTS 8,891,798 B1 * 11/2014 Laffon de Mazieres ..... H04R 1/1033 381/374

2007/0160252 A1 12/2007 Wang et al.

(Continued)

OTHER PUBLICATIONS

International Application Serial No. PCT/US2019/013987, International Search Report, dated Apr. 1, 2019, 2 pages.

(Continued)

*Primary Examiner* — Vivian C Chin
*Assistant Examiner* — Con P Tran

(57) ABSTRACT

Provided herein are wireless earbud systems that include a pair of earbuds connected at opposite ends of a lanyard. One or both earbuds may be connected to the lanyard by a releasable connection, that allows the (or each) earbud to be selectively attached to, detached from and reattached to the lanyard (or other lanyard). The earbuds contain electronics, but the lanyard is free of electrical connections. In certain examples, the wireless earbud system includes multiple lanyards of the same or different styles, colors, materials, or the like. The releasable connection allows the first and second earbuds to be selectively attached and detached from any one of the multiple lanyards, to allow a user to selectively choose and replace lanyards and/or earbuds. Each earbud may include a respective magnet (or one earbud includes a magnet and the other includes a magnetically attractable material) arranged such that the earbuds are magnetically attracted to each other, when brought together. When the earbuds are magnetically connected together, the earbuds and lanyard form a loop, and may be worn as a necklace, a bracelet, headband, belt, strap or other wearable apparel. Also provided are methods of making a wireless earbud system.

24 Claims, 23 Drawing Sheets

(56) References Cited

U.S. PATENT DOCUMENTS

| | | | | |
|---|---|---|---|---|
| 2012/0279756 | A1* | 11/2012 | Rothbaum | F16G 11/02 174/135 |
| 2014/0265312 | A1* | 9/2014 | McAlister | F16L 19/005 285/305 |
| 2014/0338397 | A1 | 11/2014 | Andreini, III et al. | |
| 2015/0230019 | A1 | 8/2015 | Sakai et al. | |
| 2016/0277824 | A1* | 9/2016 | Ushakov | H04R 1/1033 |
| 2016/0373849 | A1 | 12/2016 | Stoch | |
| 2017/0070803 | A1 | 3/2017 | Pulgam | |
| 2017/0318375 | A1* | 11/2017 | Honeycutt | H04R 1/1091 |
| 2018/0077479 | A1* | 3/2018 | Johanson | H04R 1/1066 |
| 2018/0084329 | A1 | 3/2018 | Shadowens et al. | |

OTHER PUBLICATIONS

International Application Serial No. PCT/US2019/013987, Written Opinion, dated Apr. 1, 2019, 7 pages.

* cited by examiner

WEARABLE EARBUD SYSTEM

RELATED APPLICATIONS

The present application is continuation-in-part of PCT/US2019/013987, filed Jan. 17, 2019, entitled "Wearable Earbud System,"; which claims priority to U.S. Provisional Application No. 62/618,921, filed Jan. 18, 2018, entitled "Wearable Earbud System." all of which are hereby incorporated by reference in their entirety.

TECHNICAL FIELD

Embodiments herein relate generally to wearable devices and apparel, and more specifically, to a wireless earbud system for audio output that allows earbuds to be selectively attached and detached from any one of multiple lanyards to allow a user to selectively choose and replace lanyards and/or earbuds, and wherein the earbud system may be worn as a necklace, bracelet, headband, belt, strap or other wearable apparel.

SUMMARY OF INVENTION

A wireless earbud system includes a pair of earbuds connected at opposite ends of a lanyard. One or both earbuds are connected to the lanyard by a releasable connection, that allows the (or each) earbud to be selectively attached to, detached from and reattached to the lanyard (or other lanyard). The earbuds contain electronics, but the lanyard is free of electrical connections. In certain examples, the wireless earbud system includes multiple lanyards of the same or different styles, colors, materials, or the like. The releasable connection allows the first and second earbuds to be selectively attached and detached from any one of the multiple lanyards, to allow a user to selectively choose and replace lanyards and/or earbuds. In one example, the releasable connector is a threaded connector, having first and second parts that thread together to attach.

Each earbud includes a respective magnet (or one earbud includes a magnet and the other includes a magnetically attractable material) arranged such that the earbuds are magnetically attracted to each other, when brought together. When the earbuds are magnetically connected together, the earbuds and lanyard form a loop, and may be worn as a necklace, a bracelet, headband, belt, strap or other wearable apparel.

In examples in which the earbud system is configured to be worn as a wrist or arm band or bracelet on user's wrist or arm, motion detection electronics in the earbuds may be configured to detect one or more (or a plurality of specific) motions of the user's wrist or arm. In those examples, processing electronics may be configured to interpret detected motion to provide one or more control signals for controlling one or more of the earbud system, a local or remote audio device, or other electronic device.

DETAILED DESCRIPTION

A detailed description of the embodiments of the present disclosure is provided below. While several embodiments are described, the disclosure is not limited to any one embodiment, but instead encompasses numerous alternatives, modifications and equivalents. In addition, while numerous specific details are set forth in the following description to provide a thorough understanding of the embodiments disclosed here, some embodiments can be practiced without some or all of these details. Moreover, for clarity, certain technical material that is known in the related art has not been described in detail to avoid unnecessarily obscuring the disclosure.

The embodiments of the disclosure may be understood by reference to the drawings, wherein like parts may be designated by like numerals. The components of the disclosed embodiments, as generally described and illustrated in the figures herein, could be arranged and designed in a wide variety of different configurations. Thus, the following detailed description of the embodiments of the disclosure is not intended to limit the scope of the disclosure, as claimed, but it is merely representative of possible embodiments of the disclosure. In addition, the steps of any method disclosed herein do not necessarily need to be executed in any specific order, or even sequentially, nor need the step be executed only once, unless otherwise specified.

Figure 1:
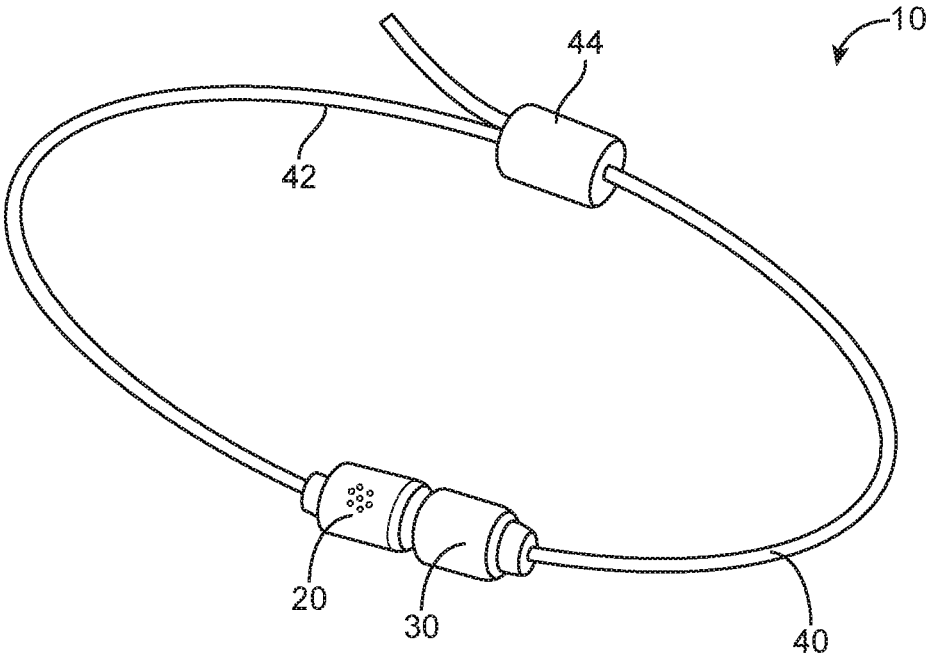
FIG. 1 is a perspective view of an earbud system.

A wireless earbud system 10 as shown in FIG. 1 includes a first earbud 20 and a second earbud 30 connected at opposite ends of a lanyard 40. In particular embodiments, one or both earbuds 20 and 30 are connected to the lanyard 40 by a releasable connection, that allows the (or each) earbud to be selectively attached to, detached from and reattached to the lanyard 40 (or other lanyard) by a user. Further embodiments of the wireless earbud system 10 include multiple lanyards 40 (e.g., of the same or different styles, colors, materials, or the like) to and from which the first and second earbuds 20 and 30 may be selectively attached and detached.

The lanyard 40 includes a lanyard cord or strap 42 formed of any suitable material including, but not limited to a rope or woven strap of nylon, cotton, hemp, metal, rubber, or other suitable material, metal chain, wire, leather, PVC, or the like. In particular examples, the lanyard cord or strap 42 has a design, style or other appearance quality that resembles jewelry, a wearable belt, band or strap, other apparel or the like. In particular examples, the lanyard cord or strap 42 (or the earbuds 20 and 30, or both) may include one or more jewels, pendants, or other decorative features.

Figure 2:
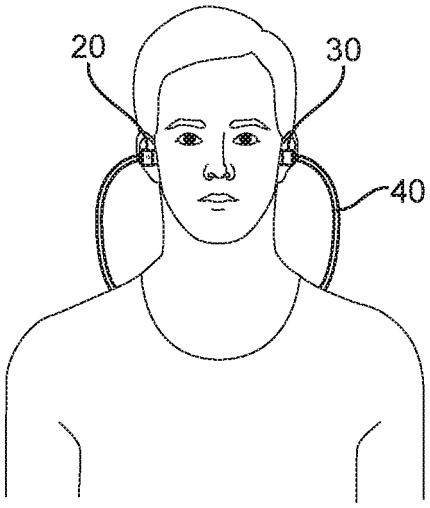
FIG. 2 is a representative diagram of a user wearing the earbud system of FIG. 1 when used as an audio device.
Figure 3:
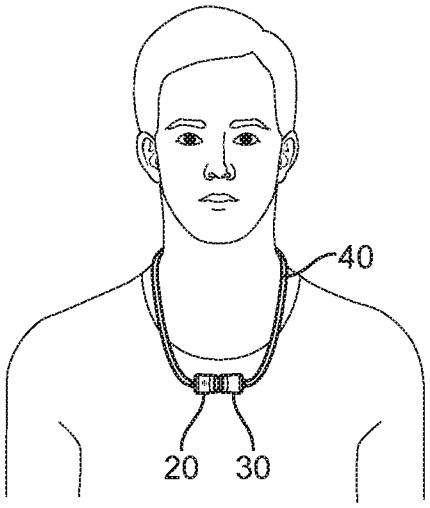
FIG. 3 is a representative diagram of a user wearing the earbud system of FIG. 1 when not in use for audio.
Figure 4:
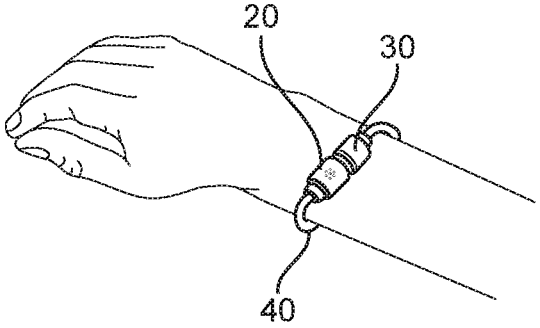
FIG. 4 is another representative diagram of a user wearing the earbud system of FIG. 1 when not in use for audio.

Each of the first and second earbuds 20 and 30 is configured to be worn on or in a user's ears and operate as an audio output device, as shown in FIG. 2. As discussed below, each earbud 20 and 30 includes a respective magnet 70 (or one earbud includes a magnet and the other includes a magnetically attractable material) arranged such that the earbuds 20 and 30 are magnetically attracted to each other, when brought together as shown in FIGS. 1 and 3. When magnetically connected, the earbuds 20 and 30 and lanyard 40 form a loop, and may be worn as a necklace (as shown in FIG. 3) or a bracelet (as shown in FIG. 4), or other wearable device, such as, but not limited to a headband or belt, depending upon the length of the lanyard 40.

The first and second earbuds 20 and 30, each include electronics 50 that: (a) provide wireless communication capabilities to receive a wireless audio signal from a local (or remote) communication device; and (b) provide audio output that a user wearing the earbud is able to hear. In certain embodiments, the electronics may provide other functions, including but not limited to user control of volume, channel, remote devices, or other suitable functions.

Figure 5:
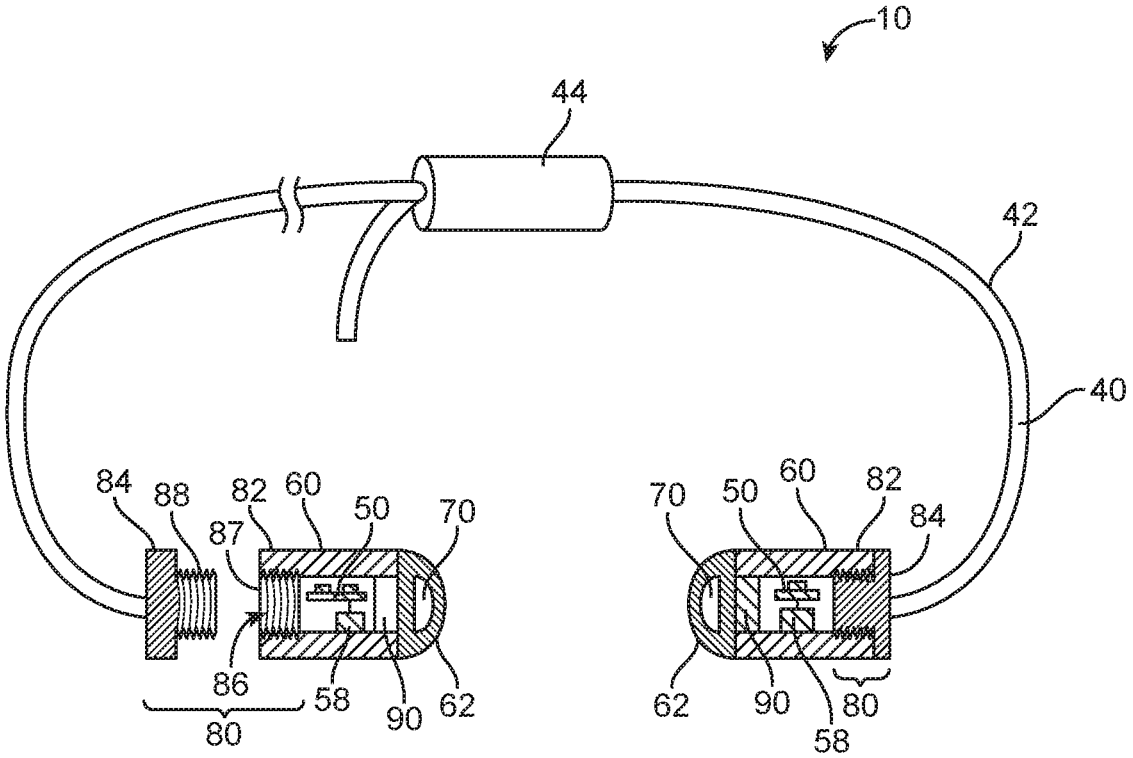
FIG. 5 is a schematic diagram of an earbud system of FIG. 1.

In particular embodiments, each earbud 20 and 30 may include a housing 60 made of any suitable material or combination of materials including, but not limited to rigid or semi-rigid plastic, rubber, metal, ceramic, composite or other materials. In the example of FIG. 5, the housing 60 contains the electronics 50, a magnet (or magnetically attractable material) 70, a first part of a releasable connector 80, and a power source (e.g., battery 90). In particular examples, the housing 60 is sweat-proof, water-resistant, or both. In particular examples, the housing 60 includes a suitable speaker port (not shown) through which audio sound is provided to a user.

Each earbud 20 and 30 is configured to be worn by a user, by fitting the housing 60 at least partially within (or connect in other manners to) a respective one of a user's ears, as shown in FIG. 2. In certain examples, the housing 60 includes an end portion 62 that is shaped to fit and be held at least partially within a user's ear, to maintain the earbud on the user's ear. For example, the end portion 62 may have a rounded or generally semispherical shape for ease of insertion into an ear. The housing 60 or end portion 62 may include or be made of a suitable material, such as, but not limited to a sufficiently soft, resilient material for user comfort. For example, the end portion 62 may be formed of, include or covered by a resilient foam rubber or other resilient material cover or the like. In other examples, the housing 60 may have other suitable configurations that allow a user to wear each of the earbuds 20 and 30 on or at least partially within a user's ear. Such other suitable configurations include, but are not limited to housings having hook members that hook over a user's ear, clip members that clip onto a user's ear or collar, or the like.

The housing 60 of each (or at least one) of the earbuds 20 and 30 includes or is attached to a first part 82 of the releasable connector 80. Each end (or at least one end) of the lanyard 40 is connected to or includes a second part 84 of the releasable connector 80. The first and second parts 82 and 84 of the releasable connector 80 are configured to be selectively attached to, detached from and reattached to each other by the user. In that manner, each releasable connector 80 allows an earbud (20 or 30) to be selectively attached to, detached from and reattached to the lanyard 40 (or other lanyard) by a user. The first and second parts 82 and 84 of the releasable connector 80 may be made of any suitable material or combination of materials including, but not limited to rigid or semi-rigid plastic, metal, ceramic, composite or other materials. In particular examples, the first part 82 of the releasable connector 80 is formed as an integral part of the housing 60 for example, but not limited to, by a molding or machining process in which the housing 60 and the part 82 of the releasable connector 80 are formed together, as a single body. In other examples, the first part 82 of the releasable connector 80 may be formed separately from the housing 60 and then fixed to the housing 60 by glue, rivet, screw, bolt, weld, solder, or other suitable adhesive.

In one example, the releasable connector 80 is a threaded connector, in which the parts 82 and 84 have threaded sections that engage and thread together to attach. In the example in FIG. 5, the first part 82 of the releasable connector 80 includes a cylindrical recess 86 that is open on one end 87 to receive at least a portion of the second part 84 of the releasable connector 80. The interior wall of the cylindrical recess 86 is threaded, in a manner of a threaded screw hole.

In the example in FIG. 5, the second part 84 of the releasable connector 80 includes a cylindrical shaft section 88 having threads on its exterior surface, in a manner of a threaded screw. The cylindrical shaft section 88 has a diameter and size configured to fit within the cylindrical recess 86 of the first part 82 of the releasable connector 80, such that the threads on the exterior surface of the shaft section 88 engage with the threads on the interior wall of the cylindrical recess 86 in a screw threading manner. The threads are configured to thread together to connect the first and second parts 82 and 84 of the threaded connector, when the threads are engaged and the first and second parts 82 and 84 of the threaded connector are rotated relative to each other in a first direction. When connected, the first and second parts 82 and 84 of the threaded connector may be rotated in a second direction (opposite to the first direction) to unthread and release the connection between the first and second parts 82 and 84 of the releasable connector 80. In this manner, the first and second parts 82 and 84 of the releasable connector 80 may be selectively connected together in a connected state as shown with the second part 84 in FIG. 5, and selectively disconnected or released from each other as shown with the first part 82 in FIG. 5.

Each end of the lanyard 40 is connected to a different respective second part 84 of the releasable connector 80, by any suitable connection structure including, but not limited to, glue, resin, knotting, embedding an end of the lanyard within the material of the first and second parts 82 and 84. In particular examples, the second part 84 of the releasable connectors 80 is connected to a respective end of the lanyard 40 by a rotary connection that allows the first part 82 of the releasable connector 80 to rotate relative to the lanyard 40. With that arrangement, the user may rotate the first part 82 of the releasable connector 80 relative to the lanyard 40, while threading the first and second parts 82 and 84 of the releasable connector 80 together or apart. In other examples, only one of the releasable connectors 80 is connected to an end of the lanyard 40 by a rotary connection, while the other releasable connector 80 is connected to the opposite end of the lanyard 40 by another connection structure as described above that is not rotary.

In the example described above and shown in FIG. 5, the first part 82 of the releasable connector 80 includes a threaded recess 86, while the second part 84 of the releasable connector includes a threaded shaft 88. In other examples, the first part 82 may include a threaded shaft, while the second part 84 may include a threaded recess, similar to those described above. In other examples, the releasable connector 80 may be configured with other suitable threaded connection structures. In yet other examples, the releasable connector 80 may include a different releasable connection structure that is not threaded, such as, but not limited to, a snap connector or a friction fitting structure in which the one of the first and second parts 82 and 84 of the releasable connector 80 has a portion that fits within or between portions of the other one of the first and second parts 82 and 84 in a friction fitting manner. In yet other examples, the releasable connector 80 may include other suitable releasable connection structure such as, but not limited to, Magnetic, ball and spring or cotter pin.

In particular embodiments, the lanyard 40 is adjustable, to fit different users, form different styles, form different wearable devices, or for other suitable purposes. For example, the lanyard 40 may include an adjustment structure 44 at one or more locations along the length of the lanyard cord or strap 42. In the example of FIGS. 1 and 5, the adjustment structure 44 comprises a tubular structure having one end attached to an end of a section of the lanyard cord 42 extending from the earbud 20, and a central channel through which a second section of the lanyard cord 42 extends from the earbud 30. The second section of the lanyard cord 42 extends all of the way through the central channel of the tubular structure and extends out of the other end of the tubular structure. The second section of the lanyard cord 42 is frictionally engaged by the tubular structure within the central channel, such that the second section of the lanyard cord 42 does not move relative to the tubular structure, unless sufficient manual force is applied to pull the second section of the lanyard cord 42 further through or in the opposite direction, to reduce or increase the size of the loop formed by the lanyard 40 and magnetically connected earbuds 20 and 30.

In other examples, other suitable adjustment structure 44 may be employed to adjust the size of the loop. Suitable adjustment structure may include, but is not limited to, knots, swage, beads, buckles, or the like. In particular examples, the adjustment structure 44 allows adjustment of the length of the lanyard 40 (from one earbud to the other earbud) within a limited range, for example, to allow for adjustment of the length to fit different users or provide different styles. Thus, for examples in which the lanyard 40 is configured to be worn as a necklace when not used as an audio device (as shown in FIG. 3), the adjustment structure 44 may allow adjustment to fit different user neck sizes, or to adjust the style of the necklace configuration (e.g., as a choker style, or as a long necklace style, or length styles there-between). In other examples, the adjustment structure 44 allows for a greater range of adjustments, for example, to change the configuration of the earbud system 10 from a necklace configuration (as shown in FIG. 3) to a bracelet configuration (as shown in FIG. 4), when not used as an audio device. In yet other examples, the adjustment structure 44 allows for a range of length adjustment that allows the earbud system 10 to be adjusted to form a headband, belt, shoulder strap or other apparel item, when not used as an audio device.

As discussed above, the first and second earbuds 20 and 30, each include electronics 50 that: (a) provide wireless communication capabilities to receive a wireless audio signal from a local (or remote) communication device; and (b) provide audio output that a user wearing the earbud is able to hear. In certain embodiments, the electronics may provide other functions, including but not limited to user control of volume, channel, remote devices, or other suitable functions. The electronics 50 may include one or more circuit boards (e.g., printed circuit board) having one or more components as described herein connected on or in the circuit board.

Figure 6:
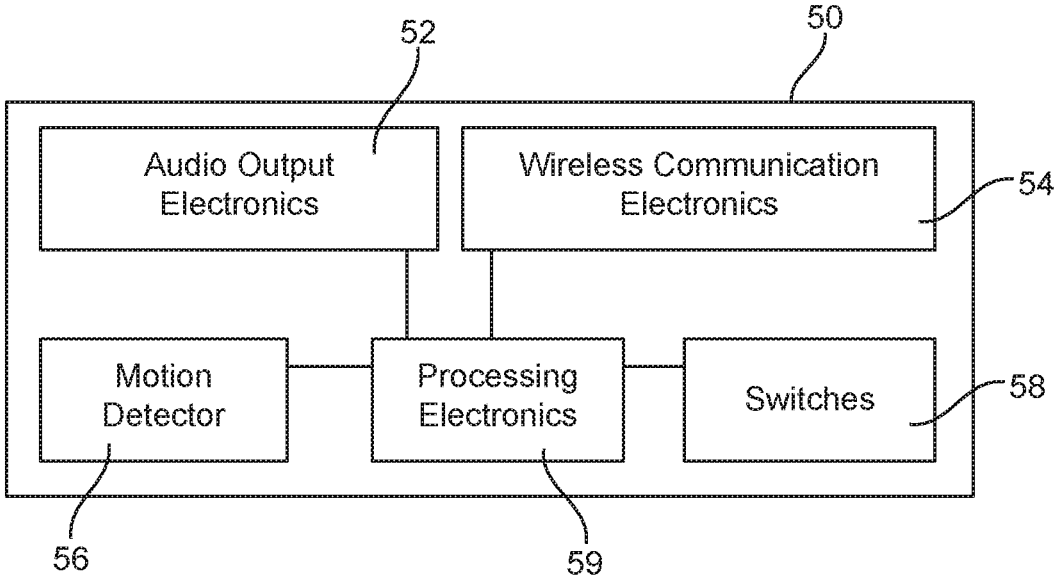
FIG. 6 is a schematic diagram of electronics in an earbud system of FIG. 1.

A schematic diagram representation of electronics 50 according to an example is shown in FIG. 6. The electronics 50 in FIG. 6 includes audio output electronics 52 and wireless communication electronics 54. In certain examples, the electronics 50 may also include one or more of motion detection electronics 56, switches 58, processing electronics 59 and visual display electronics (not shown).

The audio output electronics 52 may include any suitable electronics that allows the earbud system 10 to be used as an audio device. The audio output electronics 52 may include one or more speakers and other electronics typically included in electronic audio earpieces, including earbuds, earphones or the like The wireless communication electronics 54 may include any suitable electronics for communicating, wirelessly, with one or more devices local or remote to the earbud system 10. Such wireless communication electronics 54 may include, but is not limited to Wi-Fi. Bluetooth, UHF, or the like. The wireless communication electronics 54 may include an antenna (not shown) located within or on the housing 60, and other electronics typically included in electronic wireless communication devices.

The wireless communication electronics 54 is configured to provide a communications link with one or more local or remote devices (not shown), where the link may be one or more of a cellular telephone link (e.g., in the 700 MHz to 2700 MHz or other suitable cellular telephone frequency range), wireless local area network link (e.g., at 2.4 GHz, 5 GHz or other suitable LAN frequency), or Bluetooth link (e.g., 2.4 GHz or other suitable Bluetooth frequency). In other examples, the wireless communication link may be other near-field or short range communications links, or other longer range communication links. In particular examples, each earbud 20 and 30 may be configured to selectively receive multiple different signals. In such example, a user may select a channel, frequency, or signal type, via switches 58.

The motion detection electronics 56 may include any suitable electronics or electromechanical device that detects one or more of motion, direction of motion, speed of motion, change in direction or change in speed of motion of the earbud 20 or 30. In certain examples, the motion detection electronics 56 may include one or more of an accelerometer, vibration sensor, gyroscope or the like.

The switches 58 may include one or more user-operable switches that provide user input for control operations. The one or more switches may include any suitable user-operable electrical switch such as, but not limited to a mechanical toggle switch, button, force sensor, membrane switch, resistive sensor switch, capacitive sensor switch, other to mechanical or touch sensitive switch, or the like.

The processing electronics 59 may include one or more suitable processors or electronics capable of processing signals from and providing control functions for other components of the electronics 50. The electronics 50 (and components described herein) may be connected to receive electrical power from the power source or battery 90, via any suitable electrical connection. In particular examples, the power source includes a rechargeable battery 90 and recharging electronics that allow the battery 90 to be recharged when connected to or in sufficiently close proximity to a battery charger. For example, the recharging electronics may include an induction coil that receives power, inductively, from an inductive battery charger in sufficiently close proximity to the earbud 20 or 30. In other examples, the earbud 20 and 30 includes a port for wire connection with a battery charger, to receive power to charge the battery 90. In other examples, the battery 90 is not rechargeable or is replaceable.

In examples in which the battery 90 is replaceable, the housing 60 may be configured to selectively open and close, to provide access to the battery 90, for inserting or replacing the battery 90. In such examples, the end of the housing 60 opposite to the end connected to the lanyard 40 may be provided with a cap (e.g., the rounded portion of the housing 60 in FIG. 5) that is selectively removable from and connectable to the rest of the housing 60, by threading, snap fitting, friction fitting or other suitable connection mechanism (not shown).

The processing electronics 59 may be based on one or more microprocessors, microcontrollers, digital signal processors, baseband processors integrated circuits, application specific integrated circuits, or the like. The processing electronics 59 may include or be connected with suitable storage electronics (not shown) for storing programs or data (or both) that are used to provide functions and operations as described herein.

The electronics 50 may include other suitable electronics including, but not limited to one or more speakers, tone generators and other audio components, microphones, LEDs or other visual output devices, vibrators or other tactile output devices, or the like.

In particular examples, the electronics 50 are configured to communicate with a local or remote audio device (radio receiver, music playing device, telephone, mobile phone, computer, or the like) to receive audio signals (via the wireless communication electronics 54) and convert those signals into audio output sound to the user (via the audio output electronics 52). In one example, the electronics 50 are configured to communicate with a user's mobile phone, when in sufficiently close proximity to the mobile phone. In such examples, the user's mobile phone may include a program (application) that configures the mobile phone to communicate with the earbuds 20 and 30 of the earbud system 10, to convey audio signals to the earbud system 10, to receive control signals from the earbud system 10, or to perform other suitable functions or operations as described herein. In such examples, the processing and storage power of the user's mobile phone may be employed, such that the processing or storage capabilities or needs of the earbuds 20 and 30 may be minimized. Such examples may help to reduce cost and complexity of the earbuds 20 and 30, by employing higher processing and storage capabilities of the user's mobile phone.

One or more manually operable switches 58 may be provided, to allow a user to provide control input for controlling one or more functions or operations of the audio output electronics 52 or other components of the electronics 50. Alternatively or in addition, the switches 58 may represent one or more detectors for detecting a manual operation, such as, but not limited to a manual tap or touch or series of consecutive taps or touches on the housing of the earbud 20 or 30. For example, switches or detectors 58 may be provided for allowing a user to control one or more of an on/off operation to turn the earbud system 10 on or off, audio output volume to control the volume of the sound produced by the audio output electronics 52, channel selection to control the channel or frequency of signal received by the earbud system 10 or output by the local or remote audio device, or other functions or operations.

Accordingly, when the earbud system 10 is worn by a user (as shown in FIG. 2) and operated as an audio output device, the earbud system 10 may receive audio signals from a local or remote audio device, and produce output audio sound through the earbuds 20 and 30, that a user may hear. The user may control certain aspects of the output sound, and on/off operation, via the switches or sensors 58. When the earbuds 20 and 30 are used as an audio output device and worn in or on the user's ears, the lanyard 40 may conveniently lay behind the user's head, as shown in FIG. 2.

However, when the earbud system 10 is not operated as an audio output device, the system 10 may be worn and conveniently carried by the user, by magnetically connecting the earbuds 20 and 30 together to form a loop with the lanyard 40 that may be worn by the user as a necklace, bracelet, headband, belt, strap or other apparel item (as shown in FIGS. 3 and 4).

In examples in which the earbud system 10 is configured to be worn as a wrist or arm band or bracelet on user's wrist or arm (as shown in FIG. 4), the motion detection electronics 56 may be configured to detect one or more (or a plurality of) specific motions of the user's wrist or arm. Such specific motions may include, but are not limited to, a wave or set of multiple waves, a movement in a specified direction or series of multiple directions, one or more taps or consecutive taps, or the like. In those examples, the processing electronics 59 may be configured to interpret detected motion to provide one or more control signals for controlling one or more of the earbud system 10, the local or remote audio device, or other electronic device. For example, the motion detection electronics 56, with the processing electronics 59, may detect one or more motions and provide output control signals for controlling on/off state, volume, channel or other functions of the earbud system 10. Alternatively or in addition, the motion detection electronics 56, with the processing electronics 59, may detect one or more motions and provide output control signals that are communicated, via the wireless communication electronics 54, to one or more local or remote devices, for controlling one or more functions or operations of the one or more local or remote devices, such as, but not limited to, volume or channel of an audio output signal provided by the local or remote device.

In further examples, one or both earbuds 20 and 30 include a sensor (not shown) that operates with processing electronics 59, for detection of magnetic coupling of the earbuds 20 and 30 together, to detect whether or not the earbud system 10 is coupled in a loop (e.g., necklace, bracelet or other non-audio state). In such examples, the processing electronics 59 may be configured to control operations of the earbud 20 or 30 (or both), based in part on whether or not the sensor detects that the earbuds 20 and 30 are in a state of magnetically coupled together. For example, when the sensor and processing electronics 59 determine that the earbuds 20 and 30 are not magnetically coupled together to form a loop with the lanyard 40, then the processing electronics 59 may control the earbuds 20 and 30 to be in a first state (audio output state), to provide audio output functions corresponding to the audio output functions of traditional earbuds. In that state, the switches or detectors 58 may be configured (by the processing electronics 59) to allow user input relating to audio functions, such as, but not limited to audio output volume, answer an incoming call, end or hang up on an ongoing call, or the like. In such examples, when the sensor and processing electronics 59 determine that the earbuds 20 and 30 are magnetically coupled together to form a loop with the lanyard 40, then the processing electronics 59 may control the earbuds 20 and 40 to be in a second state (apparel state) to provide other functions, instead of or in addition to audio output functions. Such other functions may include, but are not limited to motion detection functions as described herein, display or signaling functions to inform the user of an incoming call, message, or other predefined event.

Accordingly, the functions of the earbud system 10 may change, depending upon whether or not the system 10 is in a first state (audio output state) or second state (apparel state). Alternatively. or in addition, the operations performed by the earbud system 10 in response to a particular user input (via switches or detectors 58) may be controlled to be different, depending upon the detected state (first or second state) of the earbud system 10. For example, when the sensor and processing electronics 59 determine that the earbud system is in the second state (magnetically coupled in a loop), the detection of user inputted taps may provide one or more predefined functions such as, but not limited to: sending an incoming call to voice mail in response to detection of a predefined number (two, or other number) of taps, and setting the earbud system 10 in a silent mode (to mute audio signals or output) in response to detection of another predefined number (one, or other number) of taps.

However, when the sensor and processing electronics 59 determine that the earbud system is in the first state (an audio output state, not magnetically coupled), then the sensor and processing electronics 59 may be configured to respond to the same tap sequences, but provide different functions than the functions provided in the second state (magnetically coupled state). For example, when in the first state, the detection of a predefined number (two, or other number) of taps may result in the answer of an incoming call, a forwarding of an incoming call to a defined number or voice mail, ending or hanging up on an ongoing call, forwarding to the next (or different) music or other audio track, change of a channel, or the like. Similarly, when in the first state, the detection of another predefined number (one or other predefined number) of taps may result in another function, such as, but not limited to audio pause, start, resume play, or the like.

In particular examples, all of the electronics 50 and power source (battery 90) of each earbud 20 and 30 is contained within the housing 60 of the earbud. In such examples, the lanyard 40 need not include any electronics or electrical connection. Because the earbuds 20 and 30 are connected to the lanyard 40 by releasable connectors 80, each earbud 20 and 30 may be readily disconnected from the lanyard 40, and re-connected to a different lanyard. In this manner, earbuds 20 and 30, which contain electronics 50 (and may contain relatively expensive audio or communication electronics), can be used with multiple different lanyards. Thus, the same pair of earbuds 20 and 30 may be connectable to a plurality of different lanyards of different styles, shapes, lengths, colors, etc. In one example, a kit includes a pair of earbuds 20 and 30 and a plurality of different lanyards 40 to which the earbuds 20 and 30 may connect. Thus, a user may continue to use the same earbuds 20 and 30, but selectively replace the lanyard 40 with another lanyard to fit the user's needs or style preference.

Alternatively, the same lanyard 40 may be used (at different times) with different pairs of earbuds. In those examples, one or both earbuds 20 and 30 may be removed from a lanyard 40 and easily replaced by re-connecting a different earbud to the same lanyard 40. In that manner, a user may replace a broken or malfunctioning earbud, or may replace one or both earbuds with a higher quality (higher audio fidelity) earbud, without changing the lanyard 40.

It is important to note that the present disclosure is not limited to the exemplary embodiments discussed above, and still other earbud system 10 configurations are possible without departing from embodiments of the present disclosure. For example, in the example of FIGS. 7 and 8, an exemplary earbud system 10 may include beads 100 that replace the magnets 70 shown in FIG. 5. The beads 100 may be magnetically attracted to each other (e.g., one bead includes a magnet and the other includes a magnetically attractable material). Once threaded through a lanyard 40, the magnetic beads 100 may be fixedly attached at locations along the lanyard 40 or they may slide freely along the lanyard 40. In the case where the beads 100 are configured to slide along the lanyard 40, the lanyard 40 may be threaded through bumpers 104 that keep the beads 100 a sufficient distance from earbuds 20 and 30 to prevent any magnetic fields generated by the beads 100 from interfering with the electronic components 50 of the earbuds 20 and 30.

Figure 9:
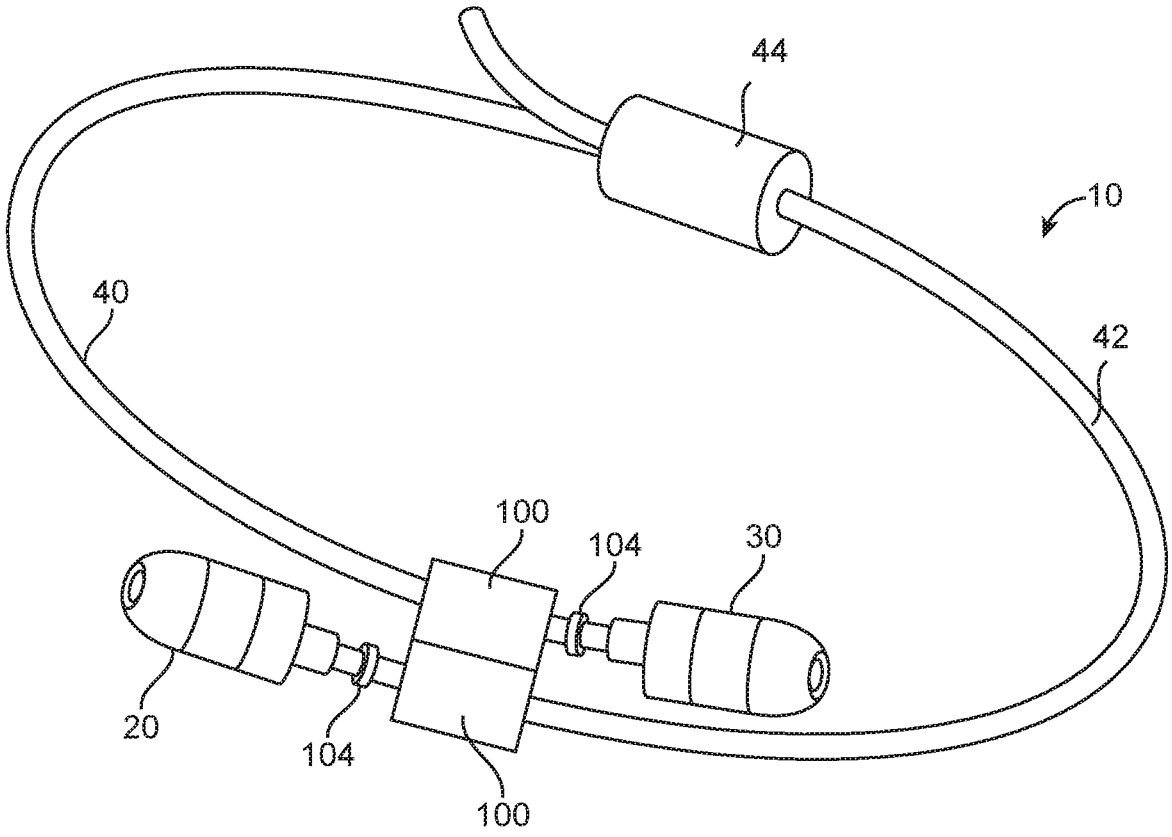
FIG. 9 is a perspective view of the earbud system of FIG. 7*a* configured in a closed loop.

A wearer can adjust the position of the beads 100 by sliding them along the lanyard 40 to bring the beads 100 together. When the beads 100 are brought together, as shown in FIG. 9, the lanyard 40 forms a closed loop, and may be worn as a necklace or a bracelet, or any other wearable article, such as, but not limited to a headband or belt, depending upon the length of the lanyard 40.

Figure 7A:
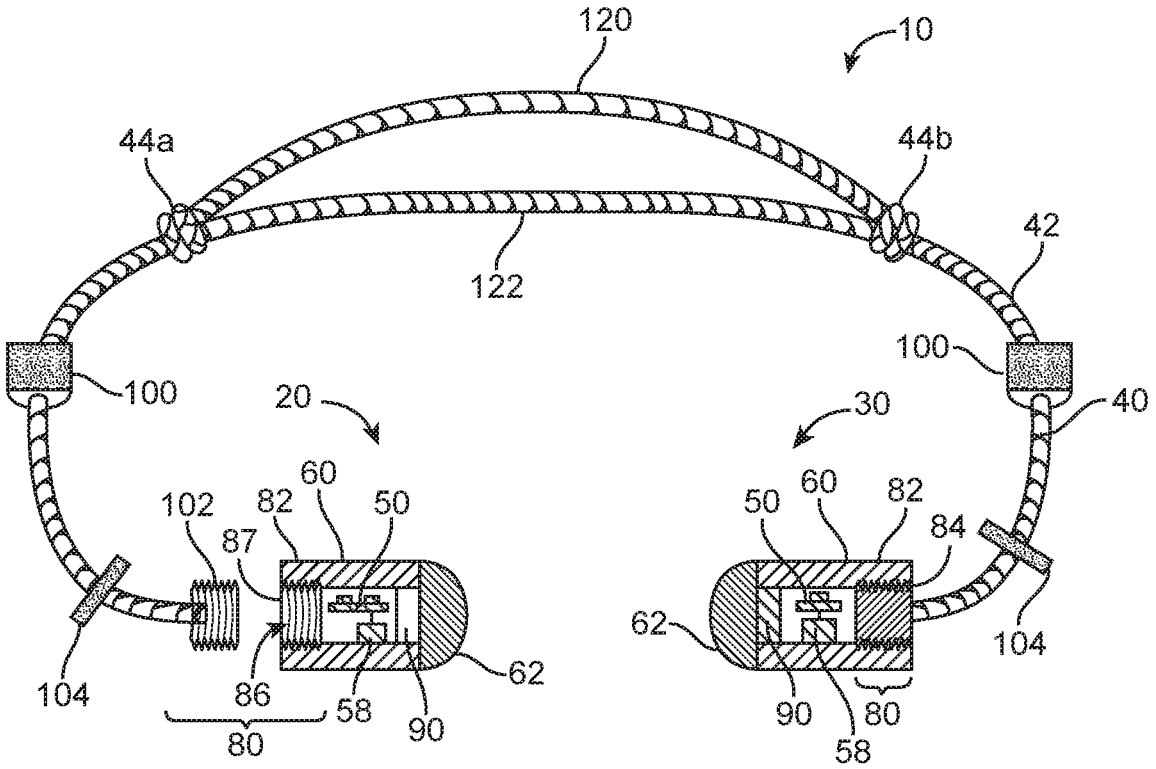
FIG. 7*a* is a schematic diagram of another earbud system.
Figure 8:
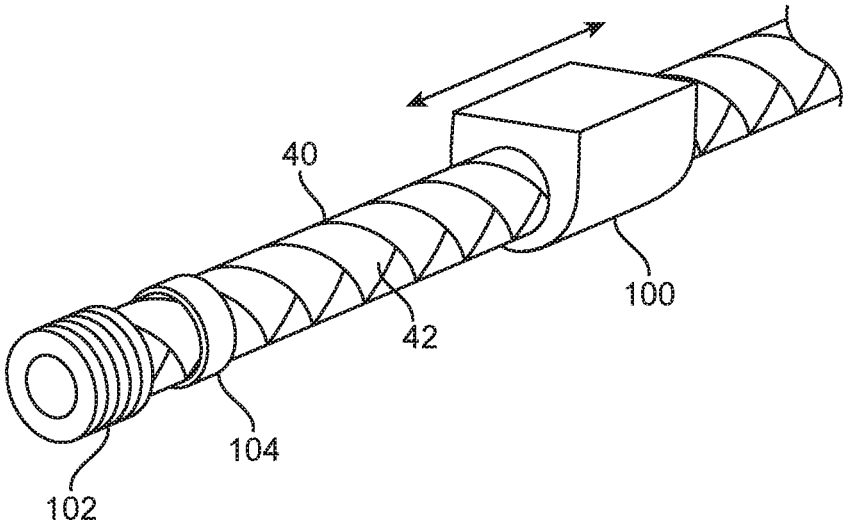
FIG. 8 is a schematic diagram of lanyard having magnetic beads and bumpers.

As further shown in the FIG. 7*a* example, the first part 82 of the releasable connector 80 may include a cylindrically-shaped threaded recess 86, while the second part of the releasable connector includes a threaded shaft 102. The threaded shaft 102 may be formed at (or attached to) the ends of a lanyard 40 as cylindrical shaft that has a diameter and size configured to fit within a corresponding threaded cylindrically threaded recess 86 of an earbud 20, 30. A connection may be formed between the lanyard 40 and earbuds 20, 30 through a turning motion that causes the threads at the outer surface of a shaft 102 engage the threads at an inner surface of a threaded recess 86 of an earbud 20, 30.

Figure 7B:
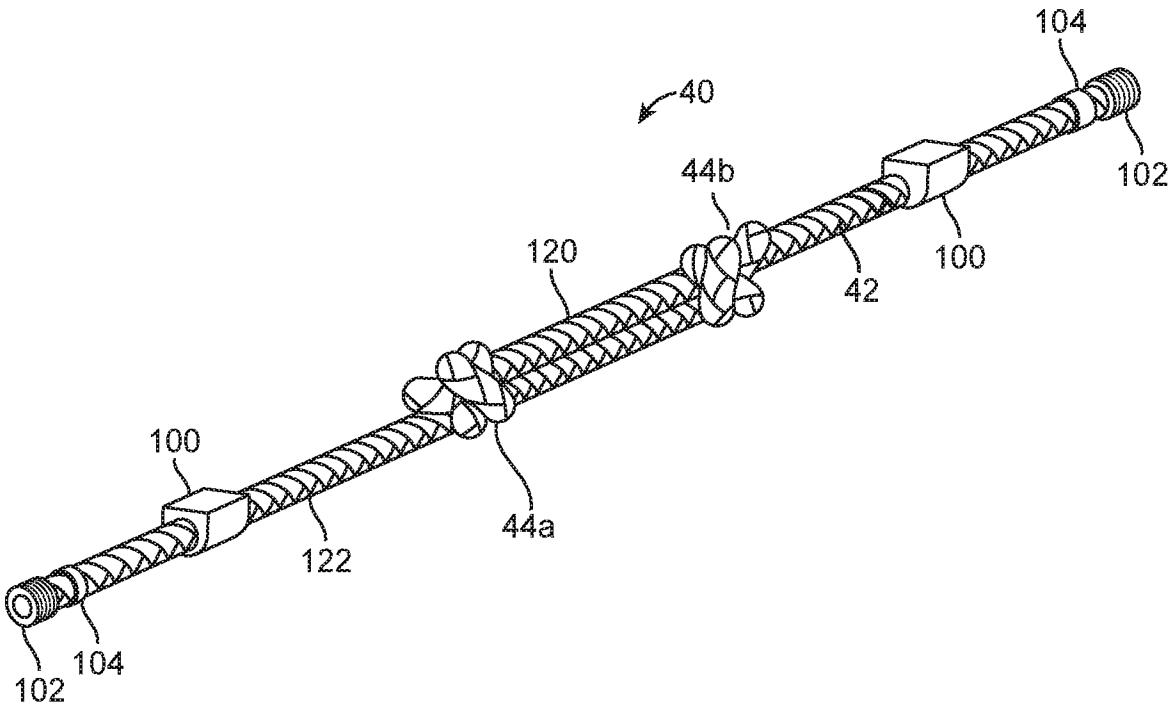
FIG. 7*b* is a schematic diagram of an adjustable lanyard.

The lanyard 40 may include a first lanyard section 120 and a second lanyard section 122. In particular embodiments, opposite ends of the first lanyard section 120 may be joined to the second lanyard section 122 using knots (e.g., slip knots) to form adjustment structures 44*a* and 44*b* at one or more locations along the length of the lanyard cord or strap 42, as shown in FIGS. 7*a*, 7*b*. 10*c* and 12*c*. The length of the lanyard 40 may be adjusted by moving the second lanyard section 122 through one or both of the knotted adjustment structures 44*a*, 44*b*.

Figure 10A:
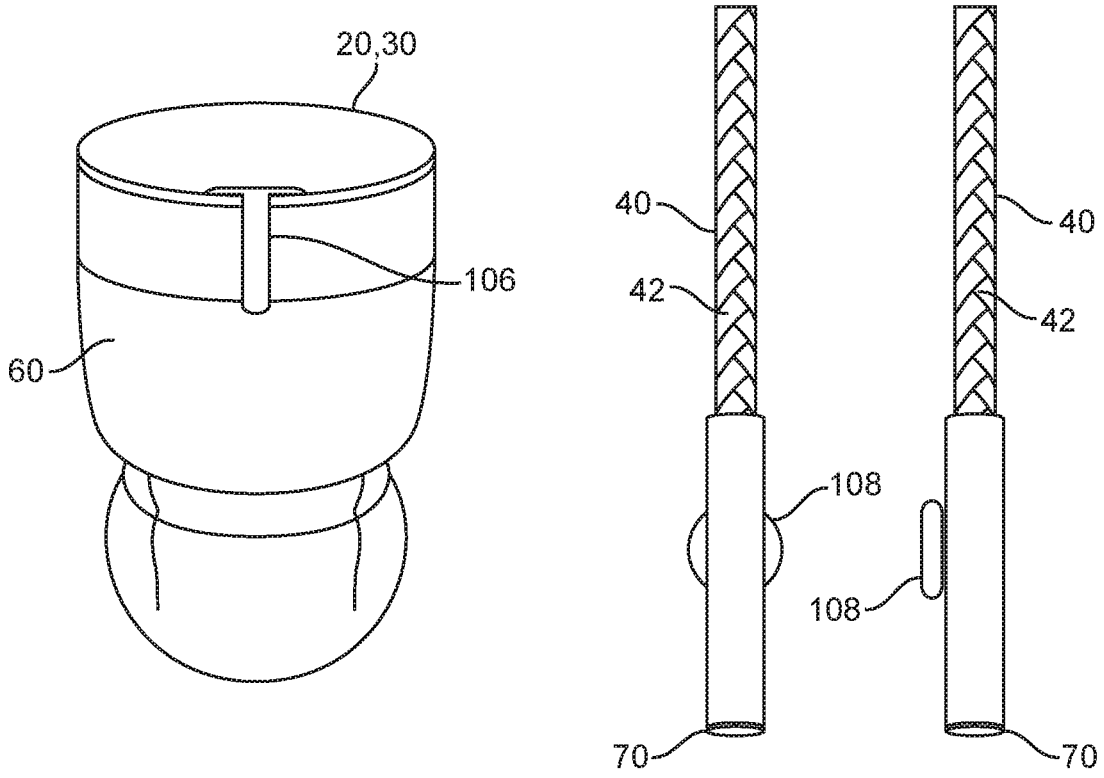
FIG. 10*a* is a schematic diagram of an earbud including a slot for coupling the earbud to a lanyard, and a lanyard including a clip for coupling the lanyard to an earbud via the slot.
Figure 10B:
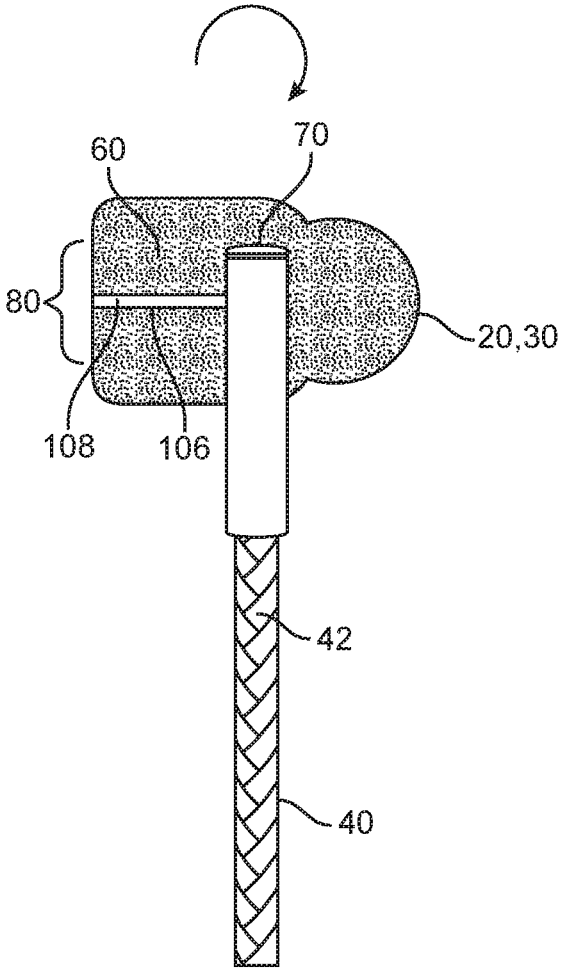
FIG. 10*b* is a schematic diagram of an earbud and lanyard coupled using the slot and clip of FIG. 10*a*.
Figure 10C:
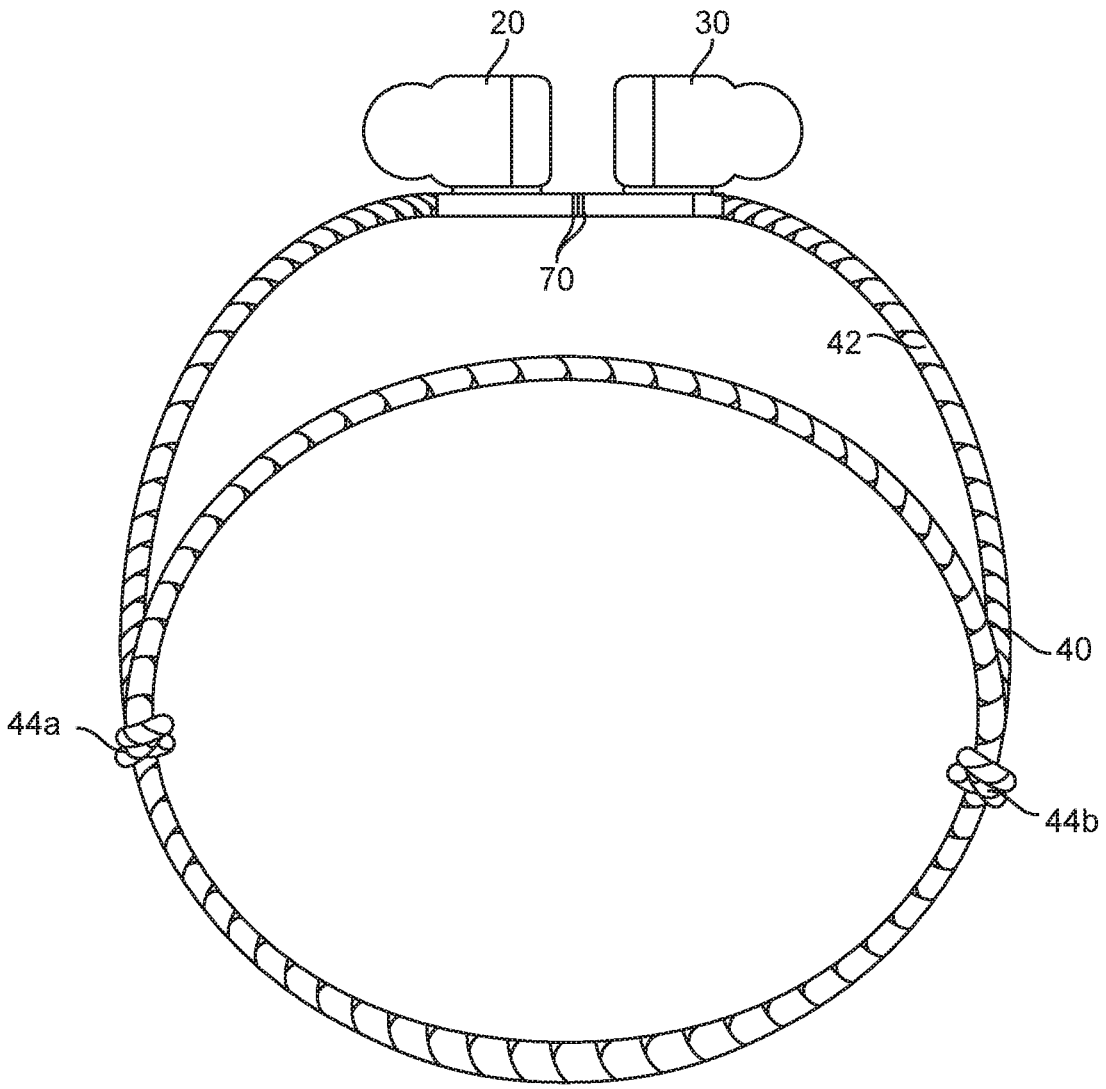
FIG. 10*c* is a schematic diagram of a closed loop lanyard of FIG. 10*a*.

Still other configurations are possible. For example, in the example of FIGS. 10*a*, 10*b* and 10*c*, the magnets 70 may be removed from each earbud housing 60 and attached to respective ends of a lanyard 40. The magnets 70 may be magnetically attracted to each other (e.g., the magnet 70 at one end of the lanyard 40 may include a magnet and a magnet 70 at the other end of the lanyard 40 may include a magnetically attractable material). In particular embodiments, the magnets 70 may be attached to a lanyard 40 using glue, crimp, friction, or any other method of attachment. When the magnets 70 are brought together, as shown in FIG. 10*c*, the lanyard 40 forms a closed loop, and may be worn as a necklace or a bracelet, or any other wearable article, such as, but not limited to a headband or belt, depending upon the length of the lanyard 40.

In this example, a releasable connector 80 may also be formed using a slot 106 and a clip 108. More specifically, a clip 108 may be attached at the respective ends of a lanyard 40 and a slot 106 having a recess to accommodate the clip 108 may be formed in the earbud housing 60. The shape of a slot 106 may be formed to accommodate clip 108 so that when the clip 108 engages (or is slid into) the slot 106, as shown in FIG. 10*b*, the two lock in place.

Figure 11A:
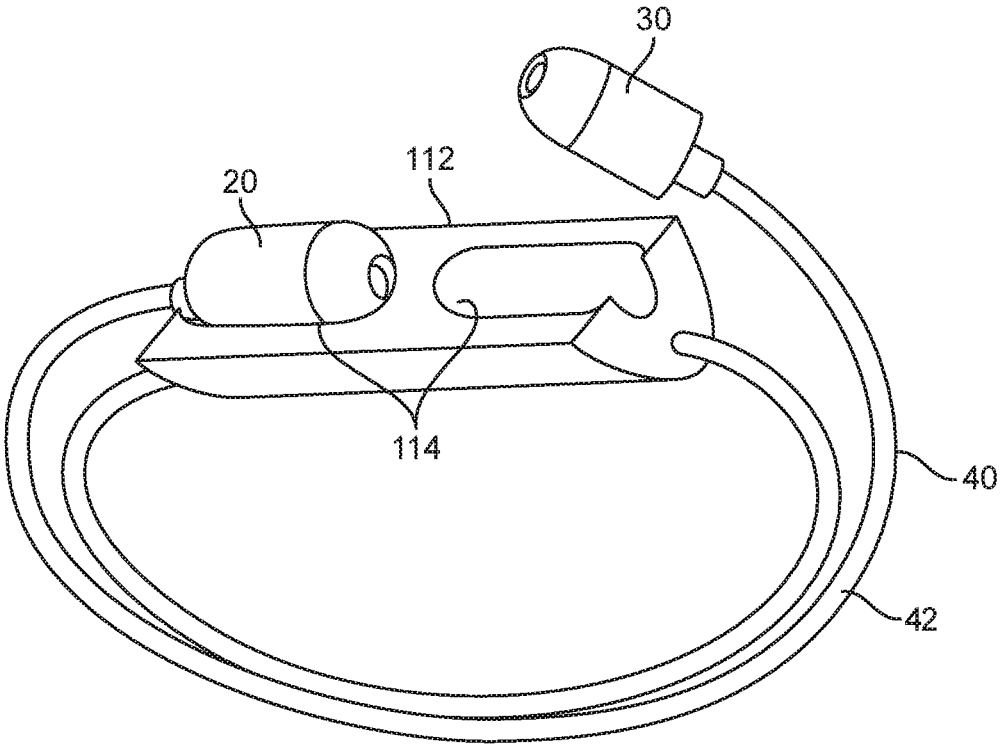
FIG. 11*a* is a schematic diagram of an earbud system including earbuds docked in a cradle and in a closed loop configuration to form a bracelet.
Figure 11B:
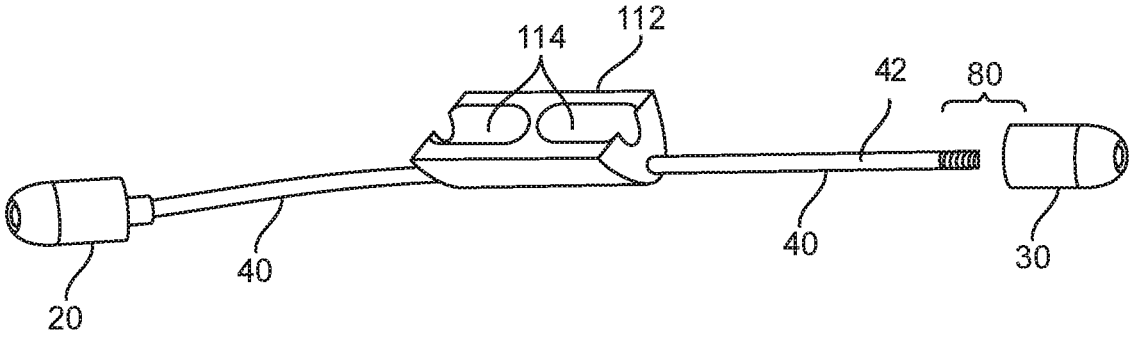
FIG. 11*b* is a schematic of the earbud system of FIG. 11*a*.
Figure 11C:
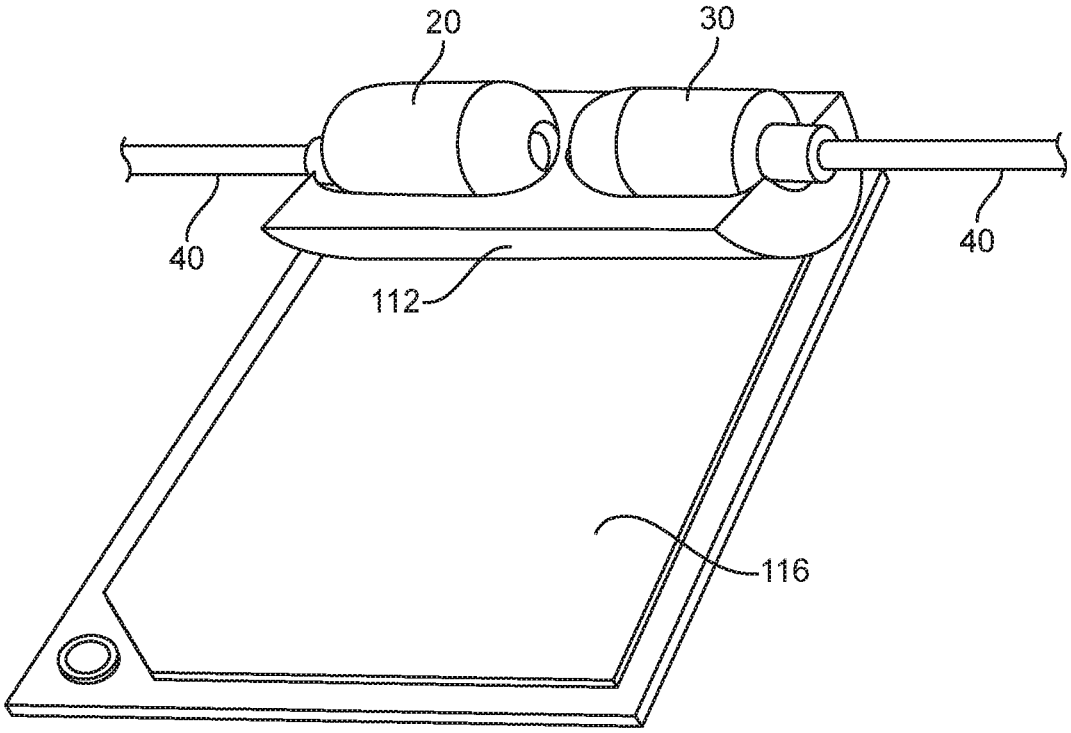
FIG. 11*c* is a schematic of the earbud system of FIG. 11*a* including the cradle connected to a battery configured to charge the earbuds.

In the example of FIGS. 11*a*, 11*b* and 11*c*, a lanyard 40 may be threaded through a cradle 112 that includes recessed areas 114 to accommodate earbuds 20,30 when the earbuds 20,30 are not being worn. In FIG. 11*a*, the lanyard 40 forms a closed looped to form a bracelet, however, any other wearable article, such as, but not limited to a headband or belt, depending upon the length of the lanyard 40, may be formed by cradling the ear buds 20, 30 in the cradle 112. In the present example, the cradle 112 and earbuds 20, 30 may be configured so that the cradle 112 and earbuds 20, 30 are magnetically attracted (e.g., the cradle 112 may include a magnet and the earbuds 20, 30 may include a magnetically attractable material). In FIG. 11*b*, a releasable connector 80 that connects an earbud 20, 30 to a lanyard 40 may be formed in any manner disclosed herein (or any equivalent thereof). Additionally, in a particular embodiment, the cradle 112 may also be magnetically connected to a battery 116 to charge the earbuds 20, 30, as shown in FIG. 11*c*.

Figure 12A:
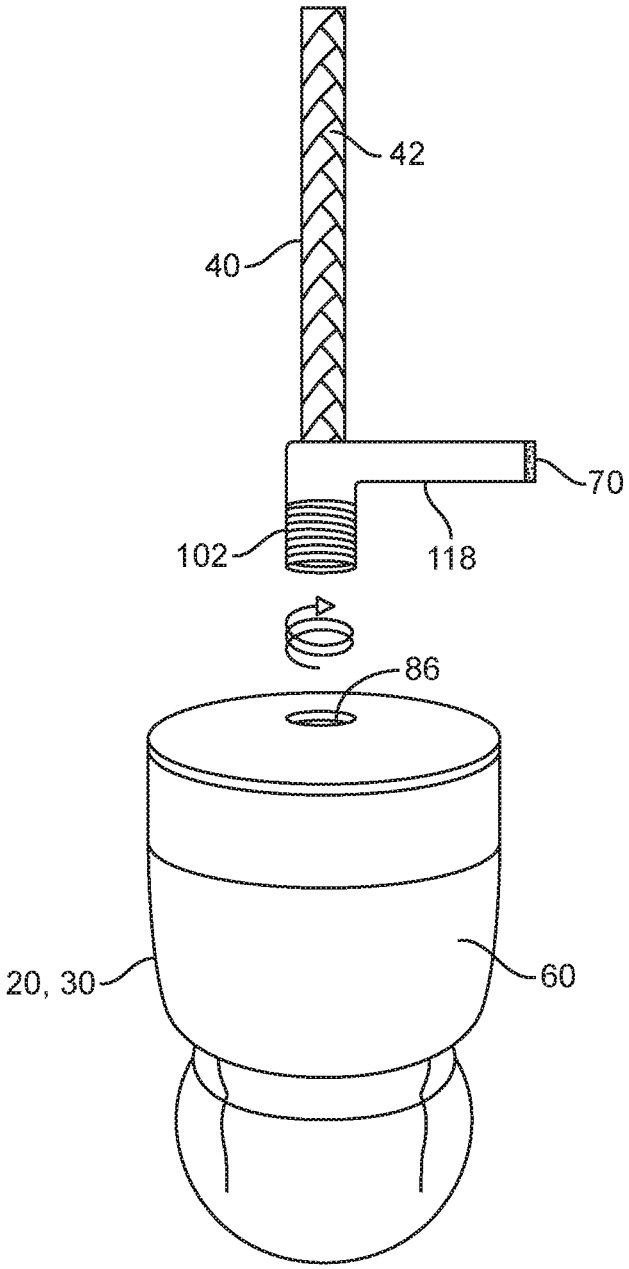
FIG. 12*a* is a schematic diagram of an earbud including a cylindrical recess for coupling the earbud to a lanyard, and a lanyard including a threaded end for coupling the lanyard to an earbud via the cylindrical recess.
Figure 12B:
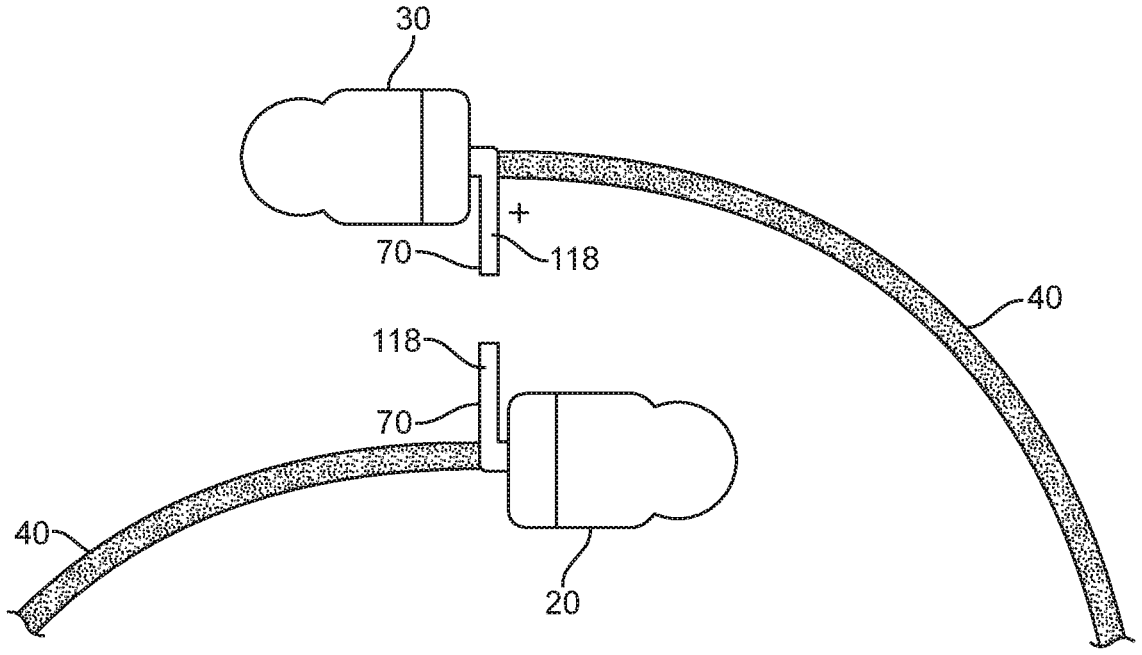
FIG. 12*b* is a schematic diagram of an earbud and lanyard coupled using the cylindrical recess and threaded end of FIG. 12*a*.
Figure 12C:
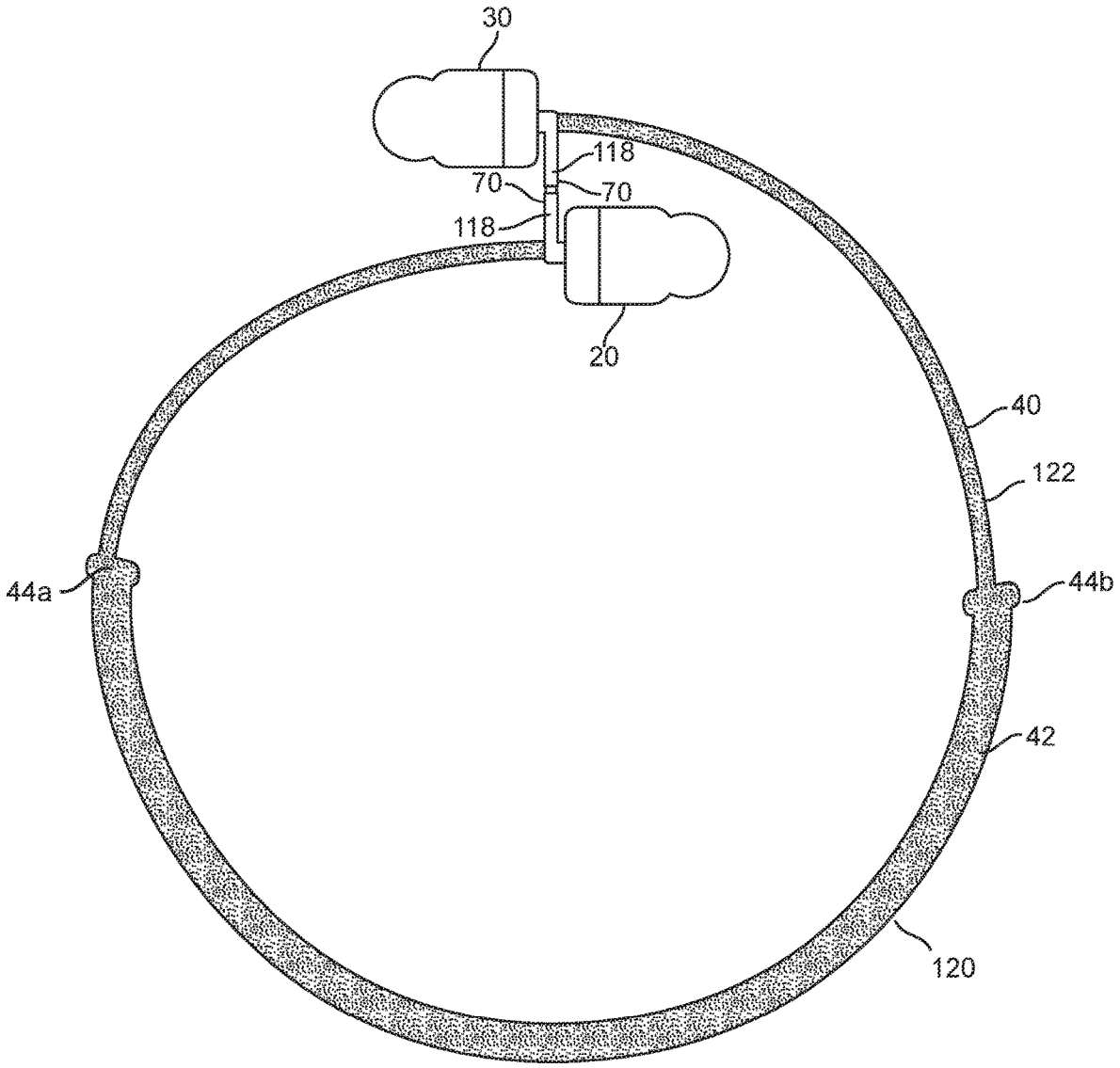
FIG. 12*c* is a schematic diagram of a closed loop lanyard of FIG. 12*a*.

In the example of FIGS. 12*a*, 12*b* and 12*c*, the magnets 70 shown in FIG. 5 may again be removed from the earbud 20, 30 housings 60. In this example, an L-shaped attachment 118 is attached at the ends of the lanyard 40. The L-shaped attachment 118 may be formed of plastic, wood, metal or other suitable materials, and may be attached to the lanyard 40 using glue, crimp, friction, or other suitable methods. The attachment 118 may include a threaded shaft 102 and a magnet 70 at an opposite end. A magnet 70 may be magnetically attracted to another magnet 70 at an opposite end of a lanyard 40 (e.g., one magnet 70 may include a magnet and the other may include a magnetically attractable material). And as discussed above, a threaded shaft 102 may be formed as cylindrical shaft that has a diameter and size configured to fit within a corresponding cylindrically-shaped threaded recess 86 of an earbud 20, 30 to join the lanyard 40 to the earbuds 20, 30, as shown in FIGS. 12*b* and 12*c*. In FIG. 12*c*, the lanyard 40 forms a closed looped to form a bracelet, however, any other wearable article, such as, but not limited to a headband or belt, depending upon the length of the lanyard 40, may be formed.

Figure 13A:
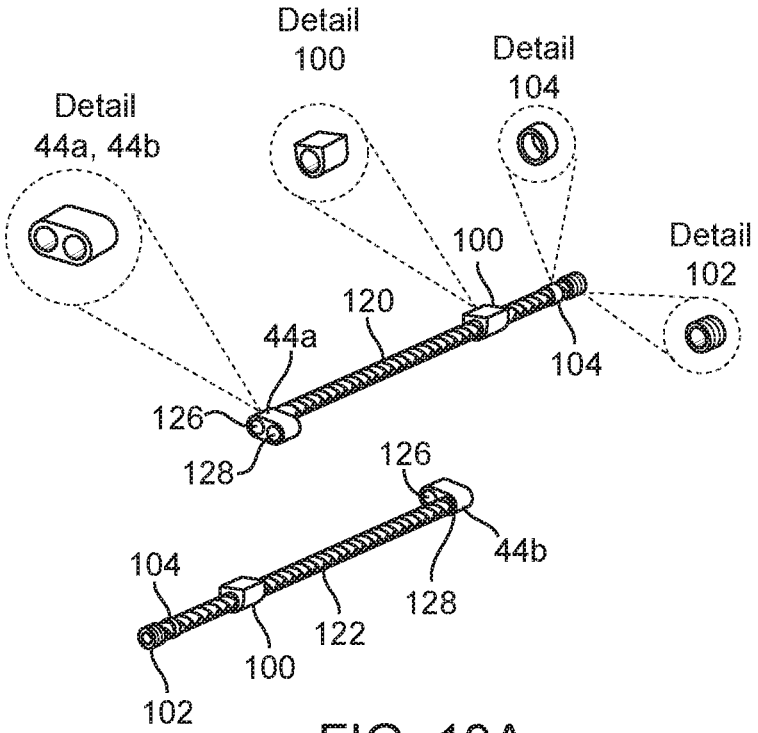
FIG. 13*a* is an exploded schematic diagram of an adjustable lanyard including magnetic beads and stoppers.
Figure 13B:
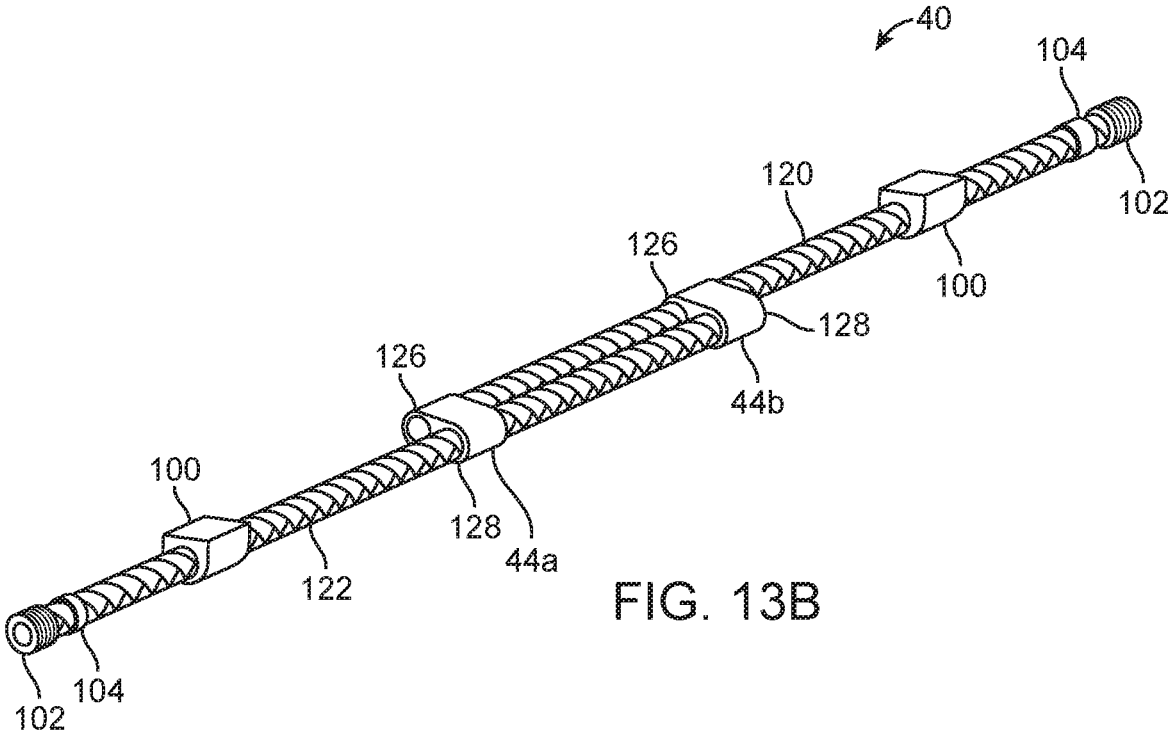
FIG. 13*b* is a schematic diagram of the adjustable lanyard of FIG. 13*a*.

In the example of FIGS. 13*a* and 13*b*, adjustment structures 44*a*. 44*b* may formed as double-barreled structures, where each adjustment structure 44*a*, 44*b* includes a first barrel 126 and a second barrel 128. In particular embodiments, a first lanyard section 120 may be threaded through a first barrel 126 of an adjustment structure 44*b* and an end of the first lanyard section 120 may be secured by (or within) a first barrel 126 of an adjustment structure 44*a*. Similarly, a second lanyard section 122 may be threaded through a second barrel 128 of the adjustment structure 44*a* and an end of the second lanyard section 122 may be secured by (or within) a second barrel 128 of the adjustment structure 44*b*. By doing so, the length of the lanyard 40 may be adjusted by moving the adjustment structure 44*b* along the lanyard section 120 and/or moving the adjustment structure 44*a* along the lanyard section 122.

Turning now to the example of FIGS. 14*a* through 14*d*, a case 200 for storing and/or charging an earbud system 10 is illustrated. The case 200 may include a charging cradle (or dongle) 202, which may be coupled to a battery 204 for charging earbuds 20 and 30 or a phone (not shown).

In one embodiment, a charging cable 206 of a charging cradle (or dongle) 202 may be connected to an external power source (not shown) to charge earbuds 20 and 30—e.g., when a charging cradle (or dongle) 202 is not being charged via a battery 204. When not being used to externally charge earbuds 20 and 20, a charging cable 206 may be stowed in a stowage port 218 of a charging cradle (or dongle) 201 and may act as a security loop, as shown in FIGS. 14*a* through 14*d*.

Figure 14B:
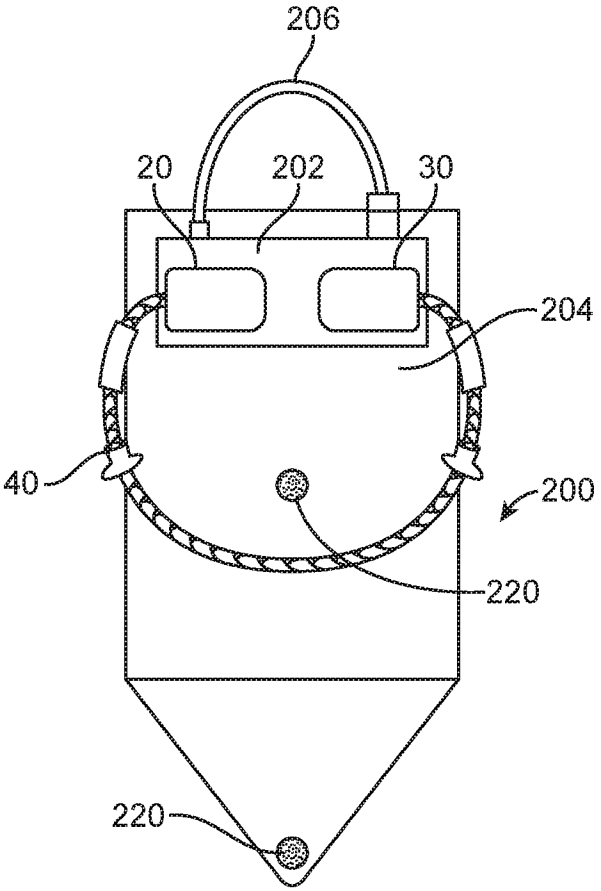
FIG. 14*b* is an open front view of the storage and/or charging case of FIG. 14*a*.
Figure 14A:
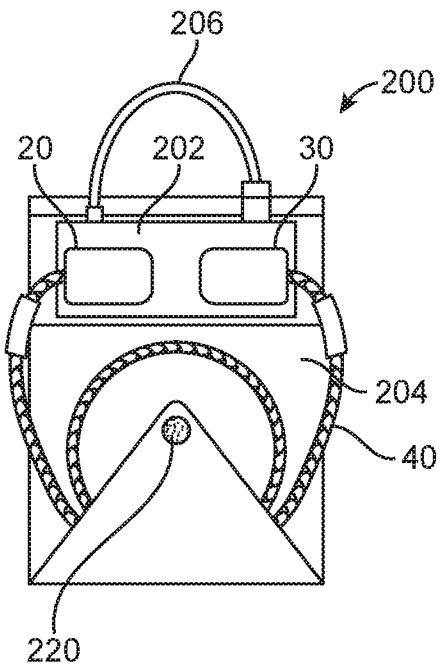
FIG. 14*a* is a closed front view of a storage and/or charging case for a wireless earbud system.
Figure 14D:
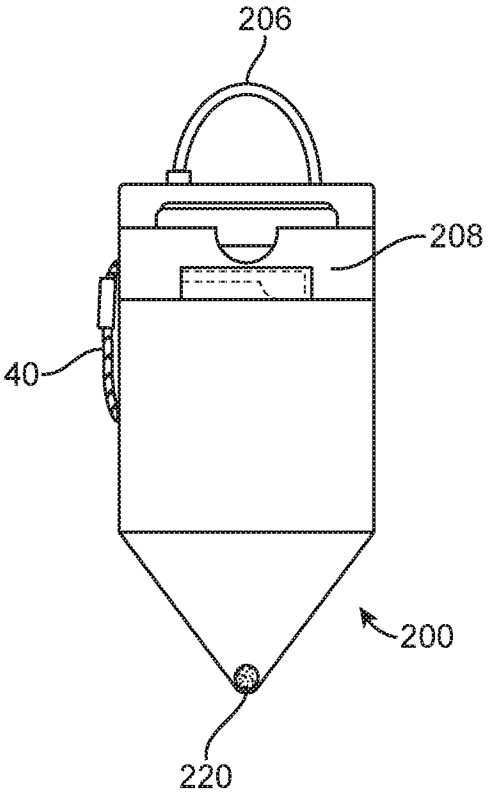
FIG. 14*d* is an open back view of the storage and/or charging case of FIG. 14*a*.
Figure 14C:
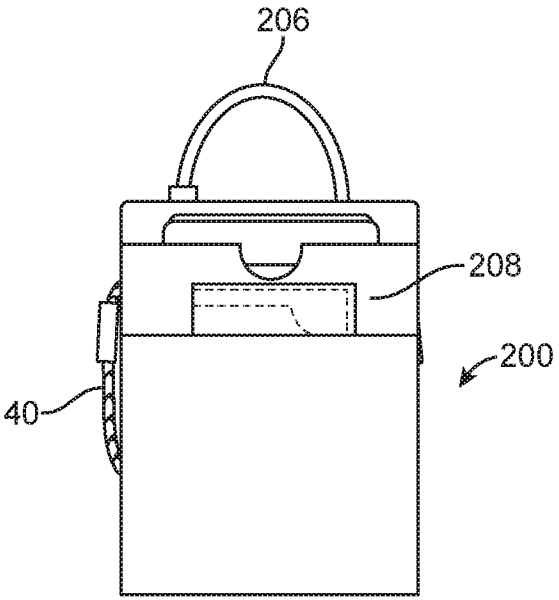
FIG. 14*c* is a closed back view of the storage and/or charging case of FIG. 14*a*.
Figure 15A:
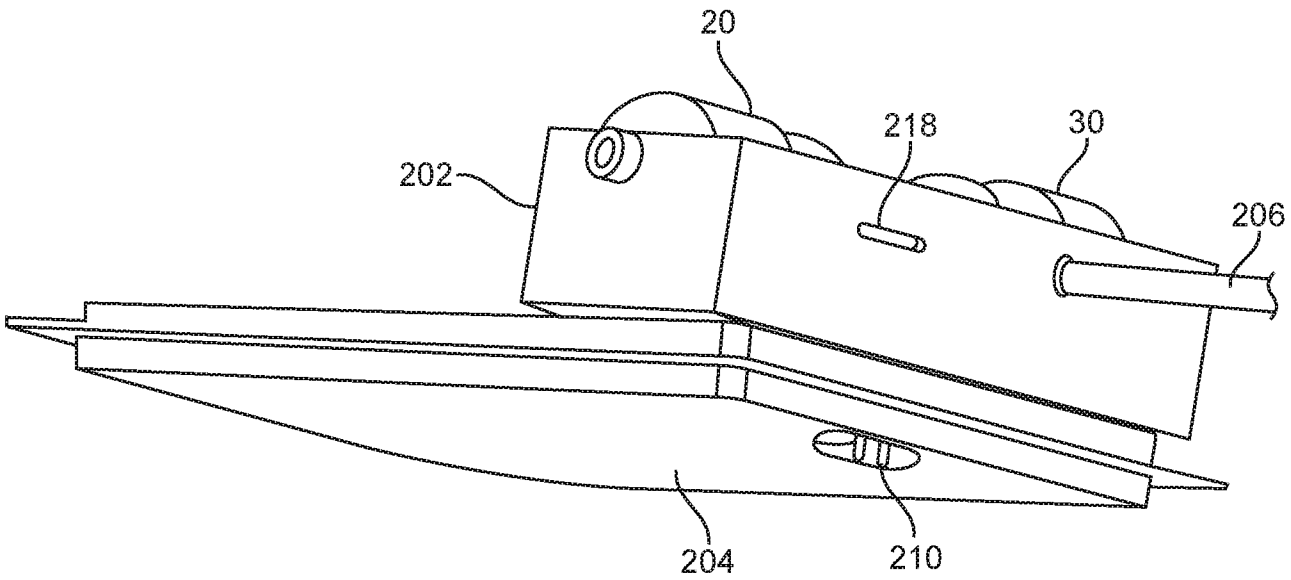
FIG. 15*a* is a side perspective view of an earbud charging cradle (or dongle) coupled to a battery.
Figure 15B:
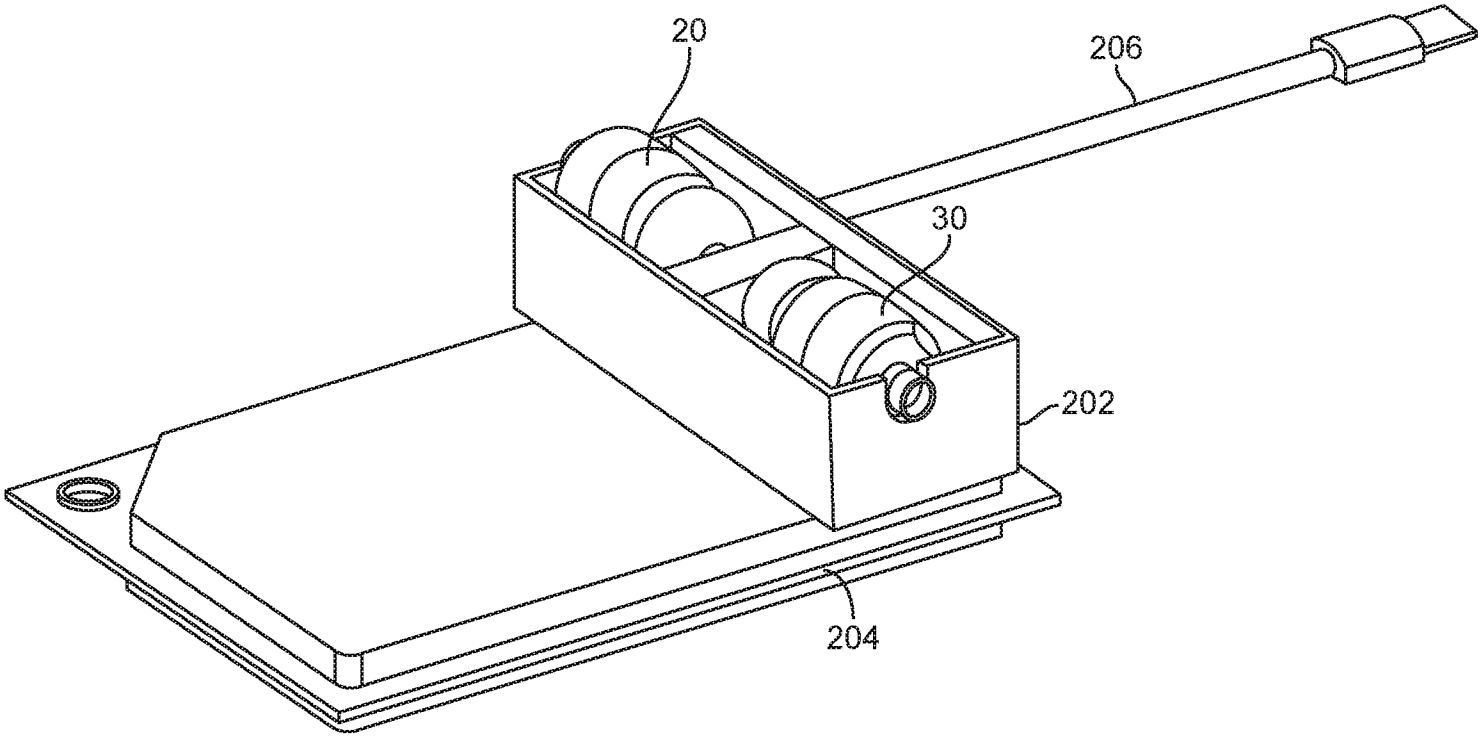
FIG. 15*b* is a top perspective view of the earbud charging cradle (or dongle) and battery of FIG. 15*a*.
Figure 15C:
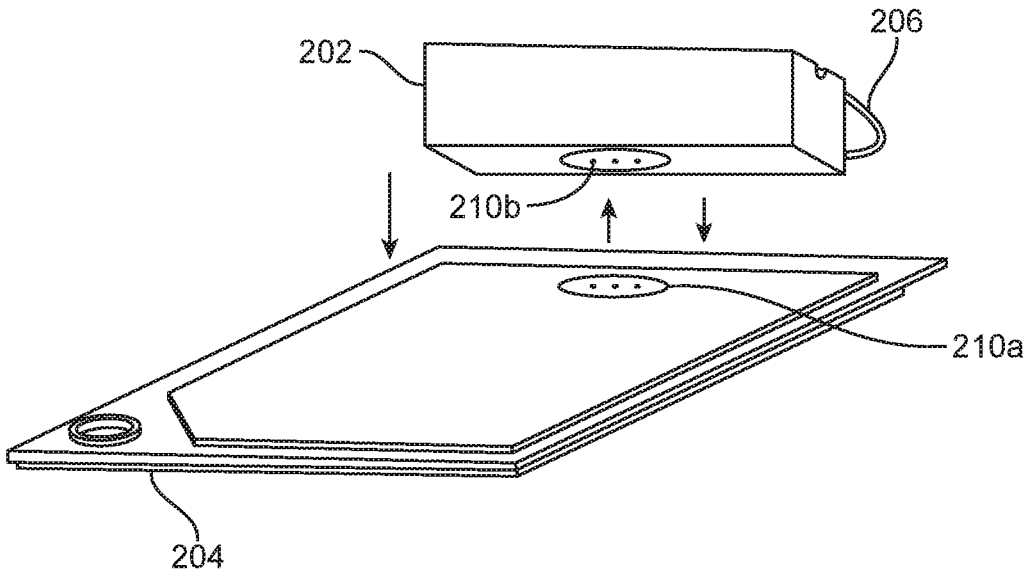
FIG. 15*c* is an exploded view of the earbud charging cradle (or dongle) and battery of FIG. 15*a*.
Figure 15D:
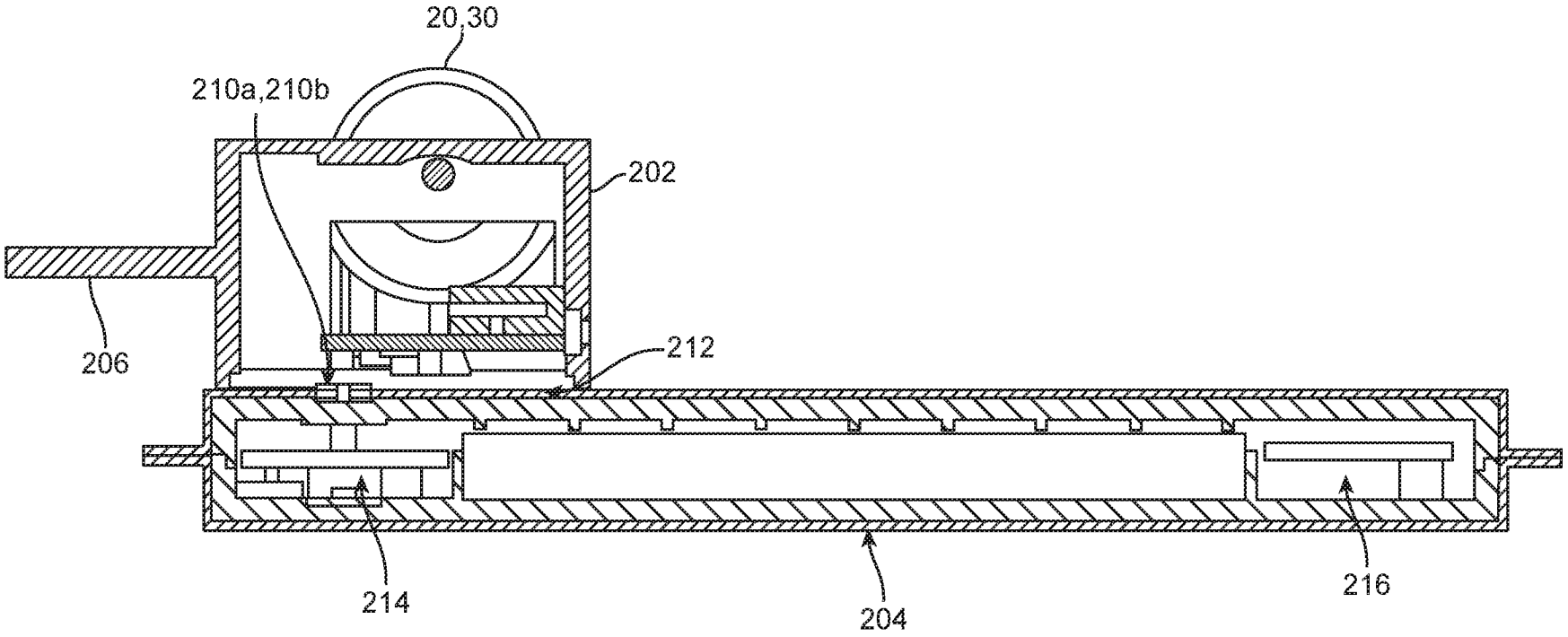
FIG. 15*d* is a side view of the earbud charging cradle (or dongle) coupled to and battery.
Figure 16A:
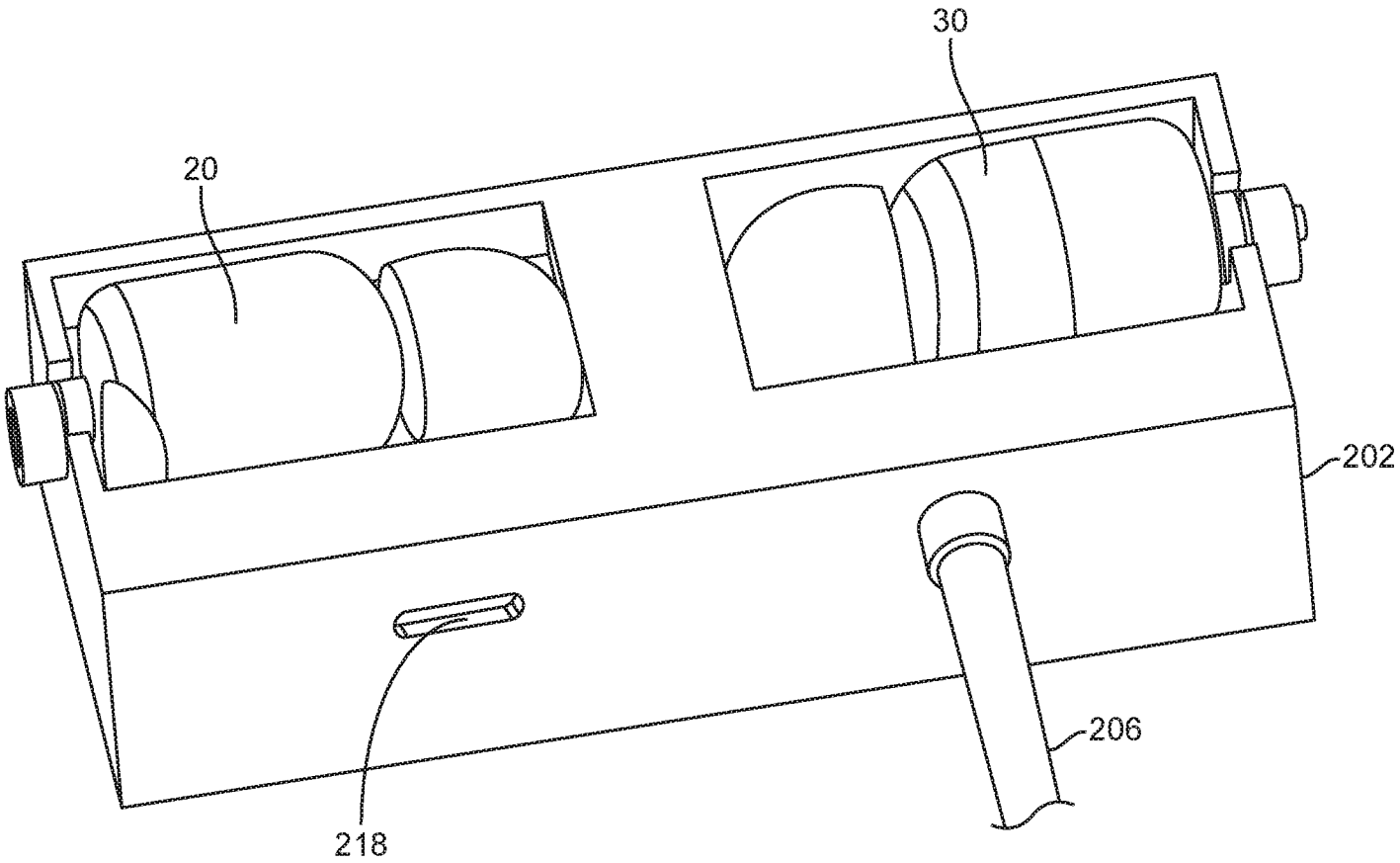
FIG. 16*a* is a side perspective view of an earbud charging cradle (or dongle) and earbuds stored therein.
Figure 16B:
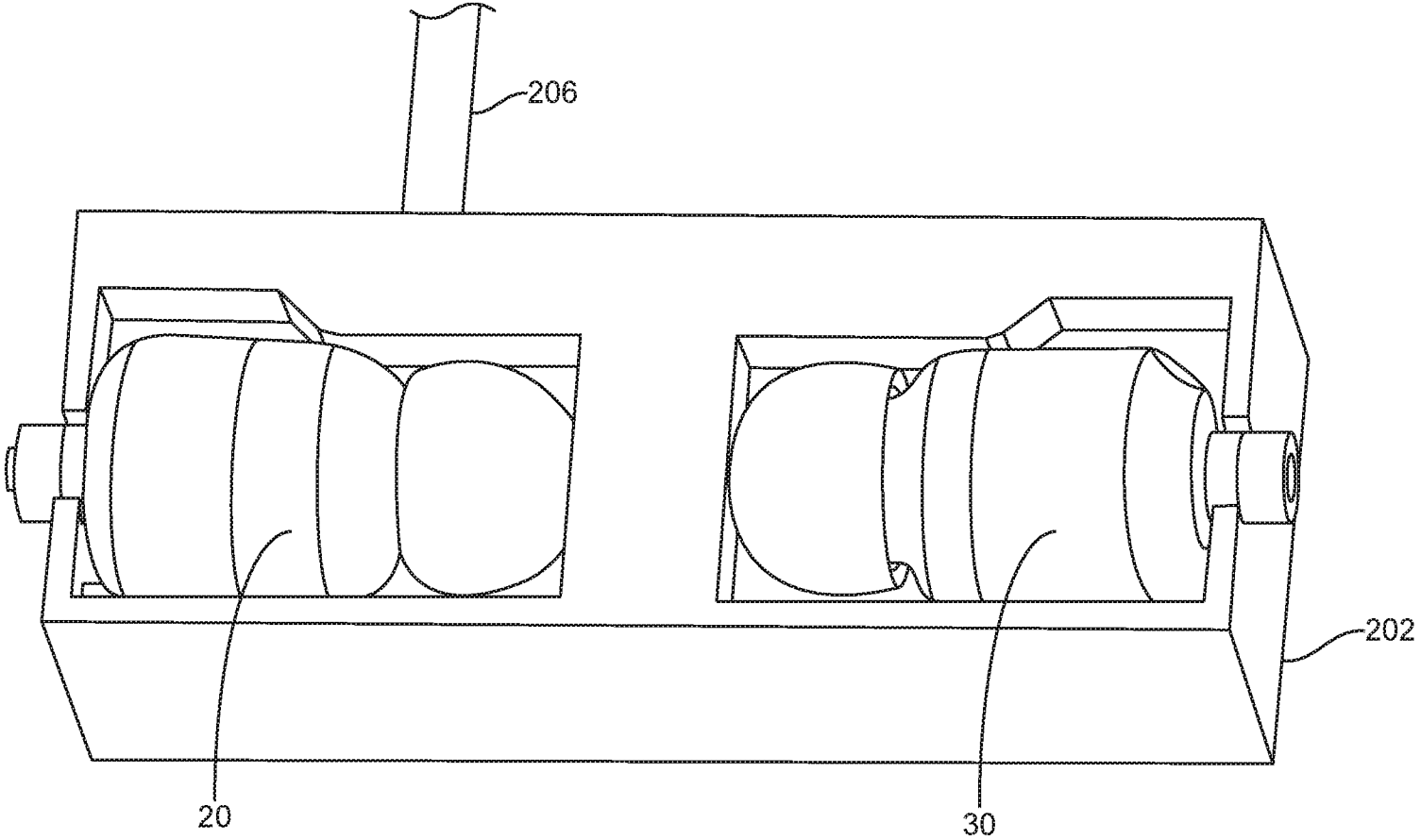
FIG. 16*b* is a top perspective view of the earbud charging cradle (or dongle) and earbuds of FIG. 16*a*.

In addition to providing storage for an earbud system 10, the case 200 may also include pockets 208 for storing credit cards and the like, as shown in FIGS. 14*c* and 14*d*. The case 200 may be made of fabric, plastic or any other suitable material. The case 200 may include closures 220 such as magnets, Velcro®, snaps or any other connection for securing the lanyard portion 40 of the earbud system 10.

In the example of FIGS. 15*a* through 15*d*, a battery 204 may be coupled to the charging cradle (or dongle) 202 via corresponding pogo pin connector elements 210*a* and 210*b* and/or a magnetic connection 212, or the like. For example, a male portion pogo pin connector element 210*a* may be included in a battery 204 and a corresponding female portion pogo pin connector element 210*b* may be included in a charging cradle (dongle) 202 so that when engaged an electrical and physical connection is made between the battery 204 and charging cradle (or dongle) 202 (or vice-versa), which allows earbuds 20 and 30 disposed in the charging cradle (or dongle) 202 to charge. In some embodiments, the battery 204 may include a printed circuit board (PCB) 214 and a battery protection board 216. The PCB 214 may control LED notifications, diagnostics, capacity, etc. The battery protection board 216 may prevent battery malfunction.

In one embodiment, the front and back sides of a battery 204 may respectively include male and female pogo pin connector elements 210*a* and 210*b* (not shown). For example, a battery 204 may have a pogo pin 210*a* on a front side and a pogo pin 210*b* on a back side so that multiple batteries 204 may be stacked and charged in parallel, which may provide increased overall battery charging capacity.

Although the foregoing has been described in some detail for purposes of clarity, it will be apparent that certain changes and modifications may be made without departing from the principles thereof. It should be noted that there are many alternative ways of implementing the systems and methods described herein. Accordingly, the present embodiments are to be considered as illustrative and not restrictive, and the invention is not limited to the details given herein, but may be modified within the scope and equivalents of the disclosed embodiments.

What is claimed is:

1. A wireless earbud system comprising:

a first earbud device configured to be worn on or in a user's first ear;

a second earbud device configured to be worn on or in a user's second ear;

a lanyard having a length section extending between the first earbud device and the second earbud device, wherein the lanyard is free of electrical connection with either of the first and second earbud devices;

at least one releasable connector connecting the lanyard to at least one of the first earbud device or the second earbud device, with a releasable connection that can be selectively, manually disconnected by the user; and a magnetic coupling, provided on the lanyard, wherein the magnetic coupling is configured to convert the lanyard into a closed loop.

2. The wireless earbud system of claim 1, wherein each releasable connector comprises a first part on one of the first or second earbud devices, and a second part on the lanyard, the first part and the second part each having threads that engage each other in a threading manner to allow the first and second parts to be connected by rotating the first and second parts relative to each other in a first direction to thread together, and released by rotating the first and second parts relative to each other in a second direction opposite the first direction to thread apart.

3. The wireless earbud system of claim 1, wherein each releasable connector comprises a first part on one of the first or second earbud devices, and a second part on the lanyard, the first part including a slot and the second part including a clip that engages the slot by sliding the clip into the slot, and which is released by sliding the clip out of the slot.

4. The wireless earbud system of claim 1, wherein the at least one releasable connector comprises a first releasable connector connecting the first earbud to the lanyard, a second releasable connector connecting the second earbud to the lanyard.

5. The wireless earbud system of claim 1, wherein each of the first and second earbud devices includes wireless communication electronics configured to receive wireless audio signals, and audio output electronics configured to provide audio sound from audio signals received by the wireless communication electronics.

6. The wireless earbud system of claim 5, wherein the wireless communication electronics comprises Bluetooth or Wi-Fi electronics.

7. The wireless earbud system of claim 1, wherein at least one of the first and second earbud devices includes motion sensing electronics configured to detect one or more predefined motions, and processing electronics configured to provide one or more control signals in response to the detection of one or more predefined motions.

8. The wireless earbud system of claim 1, further comprising a plurality of lanyards, each separately connectable to the first and second earbud devices.

9. The wireless earbud system of claim 8, wherein each lanyard of the plurality of lanyards has a different style, color, length, or width relative to each other lanyard of the plurality of lanyards.

10. The wireless earbud system of claim 1, wherein the magnetic coupling comprises a first magnetic bead and a second magnetic bead, wherein the lanyard is threaded through a hole of the first magnetic bead and the lanyard is threaded through a hole of the second magnetic bead, and wherein when the first and the second magnetic beads are brought together, the lanyard forms the closed loop.

11. The wireless earbud system of claim 10, wherein the first magnetic bead includes a magnet or a magnetically attractable material, and wherein the second magnetic bead includes a magnet or magnetically attractable material that is magnetically attracted to the magnet or magnetically attractable material in the first magnetic bead.

12. The wireless earbud system of claim 10, wherein each of the first and second magnetic beads are configured to slide freely along the lanyard.

13. The wireless earbud system of claim 10, wherein the magnetic coupling further comprises a first bumper and a second bumper, wherein the lanyard is threaded through a hole of the first bumper and the lanyard is threaded through a hole of the second bumper, wherein the first bumper is fixedly secured at a location along the lanyard that is adjacent to the first earbud device and the second bumper is fixedly secured at a location along the lanyard that is adjacent to the second earbud device, and wherein the first bumper keeps the first magnetic bead a distance from the first earbud device and the second bumper keeps the second magnetic bead a distance from the second earbud device.

14. The wireless earbud system of claim 1, wherein the magnetic coupling comprises a first magnet attached to an end of the lanyard and a second magnet attached to an opposite end of the lanyard, wherein the first magnet includes a magnet or a magnetically attractable material, wherein the second magnet includes a magnet or magnetically attractable material that is magnetically attracted to the magnet or magnetically attractable material in the first magnet, and wherein when the first magnet and the second magnet are brought together the lanyard forms the closed loop.

15. The wireless earbud system of claim 1, wherein the magnetic coupling comprises a cradle, wherein the lanyard is threaded through a hole of the cradle, and wherein the cradle and the first and the second earbuds are magnetically attracted.

16. The wireless earbud system of claim 15, wherein the cradle is magnetically attracted to a battery to charge the first and the second earbuds devices.

17. A method of making a wireless earbud system comprising:

providing a first earbud device configured to be worn on or in a user's first ear;

providing a second earbud device configured to be worn on or in a user's second ear;

extending a length section of a lanyard between the first earbud device and the second earbud device, wherein the lanyard is free of electrical connection with either of the first and second earbuds;

connecting the lanyard to at least one of the first earbud device or the second earbud device with at least one releasable connector that can be selectively, manually disconnected by the user;

providing a magnetic coupling on the lanyard, wherein the magnetic coupling is configured to convert the lanyard into a closed loop.

18. The method of claim 17, wherein each releasable connector comprises a first part on one of the first or second earbud devices, and a second part on the lanyard, the first part and the second part each having threads that engage each other in a threading manner to allow the first and second parts to be connected by rotating the first and second parts relative to each other in a first direction to thread together, and released by rotating the first and second parts relative to each other in a second direction opposite the first direction to thread apart.

19. The method of claim 17, wherein connecting the lanyard comprises connecting the lanyard to the first earbud device with a first releasable connector and connecting the lanyard to the second earbud device with a second releasable connector.

20. The method of claim 17, further comprising providing each of the first and second earbud devices with wireless communication electronics configured to receive wireless audio signals, and audio output electronics configured to provide audio sound from audio signals received by the wireless communication electronics.

21. The method of claim 20, wherein the wireless communication electronics comprises Bluetooth or Wi-Fi electronics.

22. The method of claim 17, further comprising providing at least one of the first and second earbud devices with motion sensing electronics configured to detect one or more predefined motions, and processing electronics configured to provide one or more control signals in response to the detection of the one or more predefined motions.

23. The method of claim 17, further comprising providing a plurality of lanyards from which a lanyard selection may be made, each lanyard of the plurality of lanyards being separately connectable to the first and second earbud devices, selecting a lanyard from the plurality of lanyards and connecting the first and second earbud devices to the selected lanyard.

24. The method of claim 23, wherein each lanyard of the plurality of lanyards has a different style, color, length, or width relative to each other lanyard of the plurality of lanyards.

* * * * *